US012789947B2

(12) United States Patent
Harper

(10) Patent No.: US 12,789,947 B2
(45) Date of Patent: Nov. 10, 2026

(54) METHOD AND SYSTEM FOR SHADING COVER AND SUPPORT

(71) Applicant: Robert Harper, Crested Butte, CO (US)

(72) Inventor: Robert Harper, Crested Butte, CO (US)

( * ) Notice: Subject to any disclaimer, the term of this patent is extended or adjusted under 35 U.S.C. 154(b) by 638 days.

(21) Appl. No.: 18/342,453

(22) Filed: Jun. 27, 2023

(65) Prior Publication Data

US 2023/0339575 A1 Oct. 26, 2023

Related U.S. Application Data

(63) Continuation-in-part of application No. 17/337,076, filed on Jun. 2, 2021, now Pat. No. 11,685,475.

(60) Provisional application No. 63/033,322, filed on Jun. 2, 2020.

(51) Int. Cl.
*B63B 17/02* (2006.01)

(52) U.S. Cl.
CPC ..... *B63B 17/023* (2013.01); *B63B 17/02* (2013.01); *B63B 2017/026* (2013.01)

(58) Field of Classification Search
CPC ..... B63B 17/00; B63B 17/02; B63B 17/023; B63B 2017/026
USPC ..... 114/361
See application file for complete search history.

(56) References Cited

U.S. PATENT DOCUMENTS

| | | | | |
|---|---|---|---|---|
| 2,714,387 | A * | 8/1955 | Meldrum | B63B 17/02 114/361 |
| 2,757,387 | A | 8/1956 | Kelly | |
| 2,757,677 | A | 8/1956 | Denn | |
| 3,765,434 | A * | 10/1973 | Riggs | F16M 13/022 135/20.1 |
| D431,000 | S | 9/2000 | Parks et al. | |
| 7,093,558 | B1 | 8/2006 | Mandanici | |
| 11,155,323 | B2 | 10/2021 | Fournier et al. | |
| 11,685,475 | B2 | 6/2023 | Harper | |

OTHER PUBLICATIONS

Official Action for U.S. Appl. No. 17/337,076, dated Oct. 28, 2022, 9 pages.
Notice of Allowance for U.S. Appl. No. 17/337,076, dated Feb. 8, 2023, 10 pages.

* cited by examiner

*Primary Examiner* — Lars A Olson
(74) *Attorney, Agent, or Firm* — Sheridan Ross P.C.

(57) ABSTRACT

Methods and systems for providing coverings and related support structures are provided. In various embodiments, methods and systems of the disclosure are suitable for and well adapted for use with small watercraft such as rafts. Methods and systems of the present disclosure provide a means for quick and easy assembly and disassembly of shadings and coverings as well as convenient storage.

7 Claims, 22 Drawing Sheets

METHOD AND SYSTEM FOR SHADING COVER AND SUPPORT

CROSS-REFERENCE TO RELATED APPLICATIONS

This Continuation-in-Part Application claims priority to U.S. patent application Ser. No. 17/337,076, filed Jun. 2, 2021, and issued as U.S. Pat. No. 11,685,475 on Jun. 27, 2023; which claims the benefit of priority from U.S. Provisional Patent Application No. 63/033,322, filed Jun. 2, 2020; the entire disclosures of each of which are hereby incorporated by reference.

FIELD

The present disclosure relates to coverings and shading devices. In various embodiments, the present disclosure provides methods and systems for providing a canopy and shading device on rafts and small boats.

BACKGROUND

Umbrellas and sunshades provide the often-appreciated function of protecting rafters and boaters from the elements. Whether that protection is from the sun or rain, the use of an umbrella or sunshade can be the difference between enjoying a day on the water and suffering through adverse conditions.

Such umbrellas and sunshades take many forms. One such iteration is the common awning known as a bimini top, which can provide a large area of protection, but involves storage that is often cumbersome. Another iteration is the centrally supported umbrella, which is also awkward, difficult to stow, unstable in wind, and does not provide a large area of protection. Another iteration is the umbrella supported from above by cables, locks, and hinges, which provides a large area of protection and can be stowed in a small area but requires a complex erection process.

SUMMARY

Accordingly, there has been a long-felt and unmet need to provide a covering and/or sunshade that has a large area of protection, can be erected and stowed easily, and can be stowed without interfering with large portions or operations of a raft, boat, or other area to be covered.

Various embodiments of the present disclosure provide methods and systems for a removable and storable shading device suitable for use on rafts and small boats. Although various embodiments of the present disclosure are contemplated for use with boats and watercraft, it will be recognized that embodiments of the present disclosure are not limited to use with such objects and may be provided in combination with various objects including, but not limited to, ground surfaces, furniture and tables, automobiles (truck beds, for example), decks and patios, and any object or environment for which shade and covering is desired.

In various embodiments, systems of the present disclosure comprise a frame member with at least one knuckle that is selectively securable to an object (e.g., coupled to the metal frame of a raft or boat) to secure a covering system to the object. Knuckles of the present disclosure are selectively connected to one or more uprights or vertical support, where knuckles and attachment members may be considered equivalent, for purposes of the present disclosure. A shade member (e.g., a fabric shade member) is provided that comprises holes and grommets operable to secure the shade member to the frame member.

In various embodiments, methods and systems for a removable and storable shading device are provided. Methods and systems of the present disclosure are suitable for use with rafts and small boats, but no limitation with respect to the intended use of embodiments of the present disclosure is provided herewith. In certain embodiments, devices of the present disclosure comprise at least one telescoping upright that detachably couples to a pre-existing object, such as the frame of a raft or boat. In preferred embodiments, a covering or shade member is provided. The covering is contemplated as comprising, but is not limited to, a fabric covering suitable for use as a barrier from the elements (sun, rain, wind, etc.).

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Embodiments of the present disclosure have significant benefits across a broad spectrum of endeavors. It is the Applicant's intent that this specification be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Figure 1:
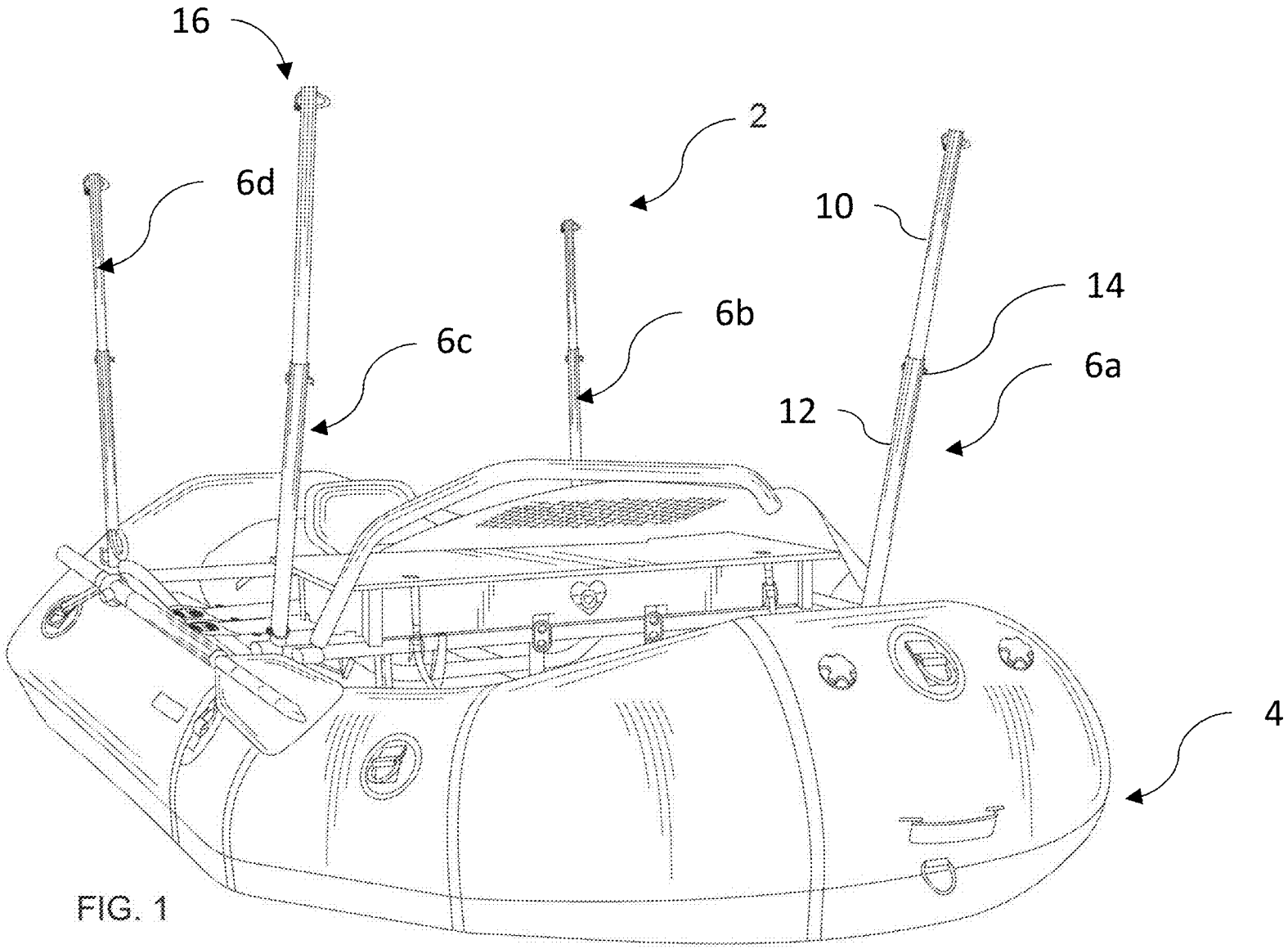
FIG. 1 is a perspective view of a portion of a covering system according to one embodiment of the present disclosure shown in combination with a raft.

FIG. 1 is a perspective view of a portion of a shade and covering system 2 according to one embodiment of the present disclosure. As shown, the system 2 is provided in combination with a watercraft 4 which is depicted as a raft in FIG. 1. It will be recognized, however, that systems of the present disclosure can be provided with various objects and devices including different watercraft, fixed objects, semi-fixed objects (e.g., tables). Accordingly, the raft 4 of FIG. 1 is shown for illustrative purposes and no limitation is provided herewith with respect to the intended use of the system 2.

As shown in FIG. 1, the system 2 comprises a plurality of upright supports 6*a*, 6*b*, 6*c*, 6*d*. The upright supports 6 are contemplated as being selectively connected to a pre-existing frame 8 of a watercraft 4 (for example) or other pre-existing component. The connection between the upright supports 6 and the frame of the watercraft is not detailed in FIG. 1 and will be described later. The upright supports 6 of FIG. 1 are contemplated as comprising telescoping members wherein a first portion 10 and a second portion 12 of each of the upright members are selectively translatable relative to one another and can be secured in a plurality of different relative positions. The first portion 10 and second portion 12 are selectively securable via pins 14 operable to extend through at least a portion of the first members and the second members. The upright members 6 are contemplated as comprising supports that extend vertically above a device 4. The distal ends 16 of the supports 6 are contemplated as comprising connection points for a covering (for example). It is also contemplated, however, that frame components including upright supports and related connection members are suitable for supporting various objects including, for example, fishing rods, flags, lights, storage accessories, speakers, drink holders, and sails.

Figure 2:
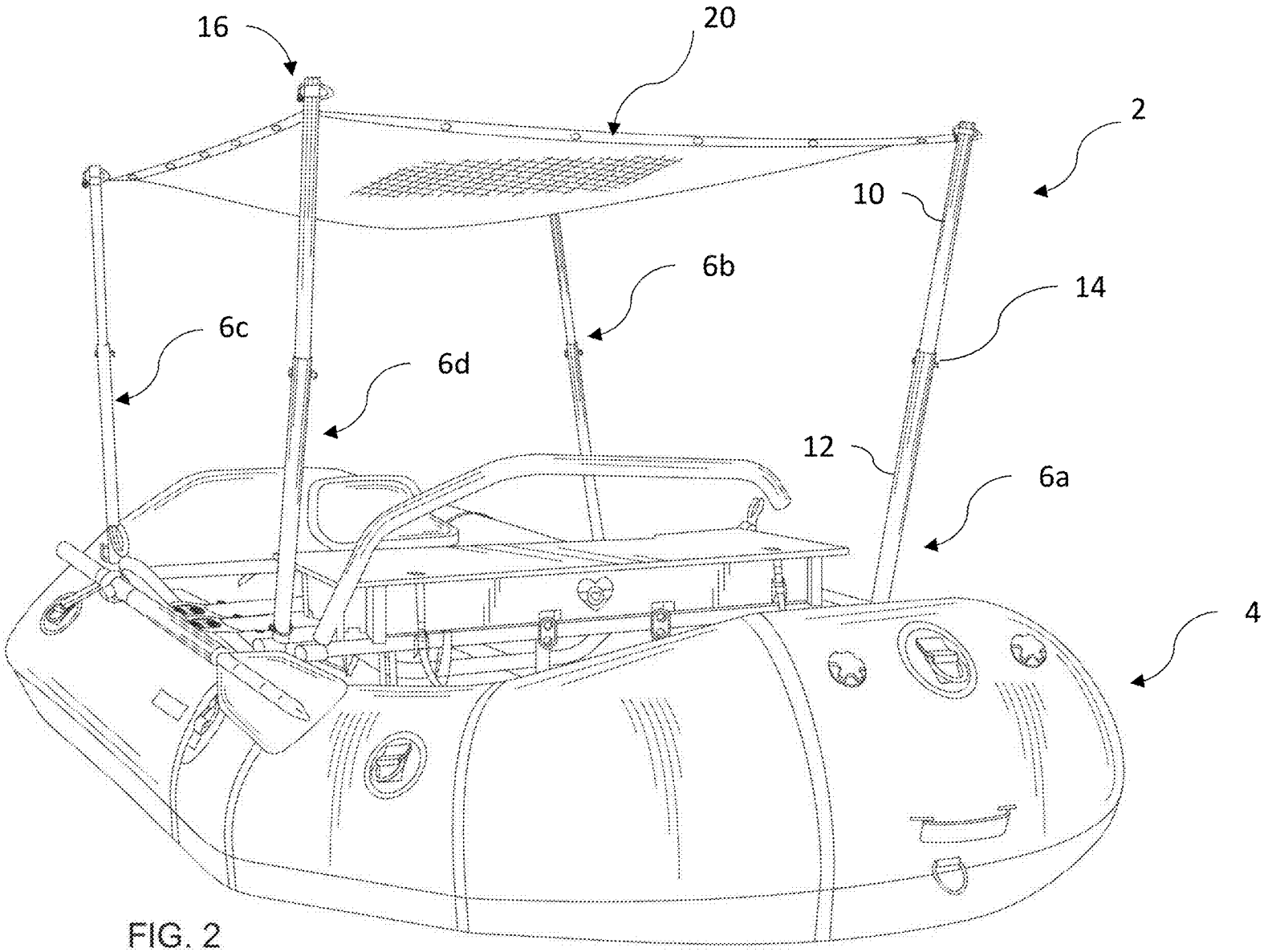
FIG. 2 is a perspective view of a covering system according to an embodiment of the present disclosure shown in combination with a raft.

FIG. 2 is a perspective view of the system 2 and watercraft 4 according to the embodiment of FIG. 1. As shown in FIG. 2, a cover member 20 is provided. The cover member 20 extends between and is connected to at least some of the plurality of upright supports 6 to span an area over the watercraft 4 and provide covering and shade thereto. Although four upright supports 6 and a generally rectangular cover 20 are shown in FIG. 2, the present disclosure is not limited to such arrangements. Greater or fewer than four upright supports are contemplated, as are different shaped coverings 20. The covering 20 is contemplated as comprising various materials. For example, the covering 20 may comprise a lightweight porous member that is suitable for providing shade and sun protection. The covering 20 is also contemplated as comprising a water resistant or waterproof covering to repel sun and water.

Embodiments of the present disclosure provide support structures and connection members that facilitate the support of a shade or cover member 20 in various positions. As shown and described herein, various components of the present disclosure allow for positioning and repositioning of a cover by allowing selective rotation of upright support members 6 as well as selective expansion and contraction of the supports 6.

Figure 3:
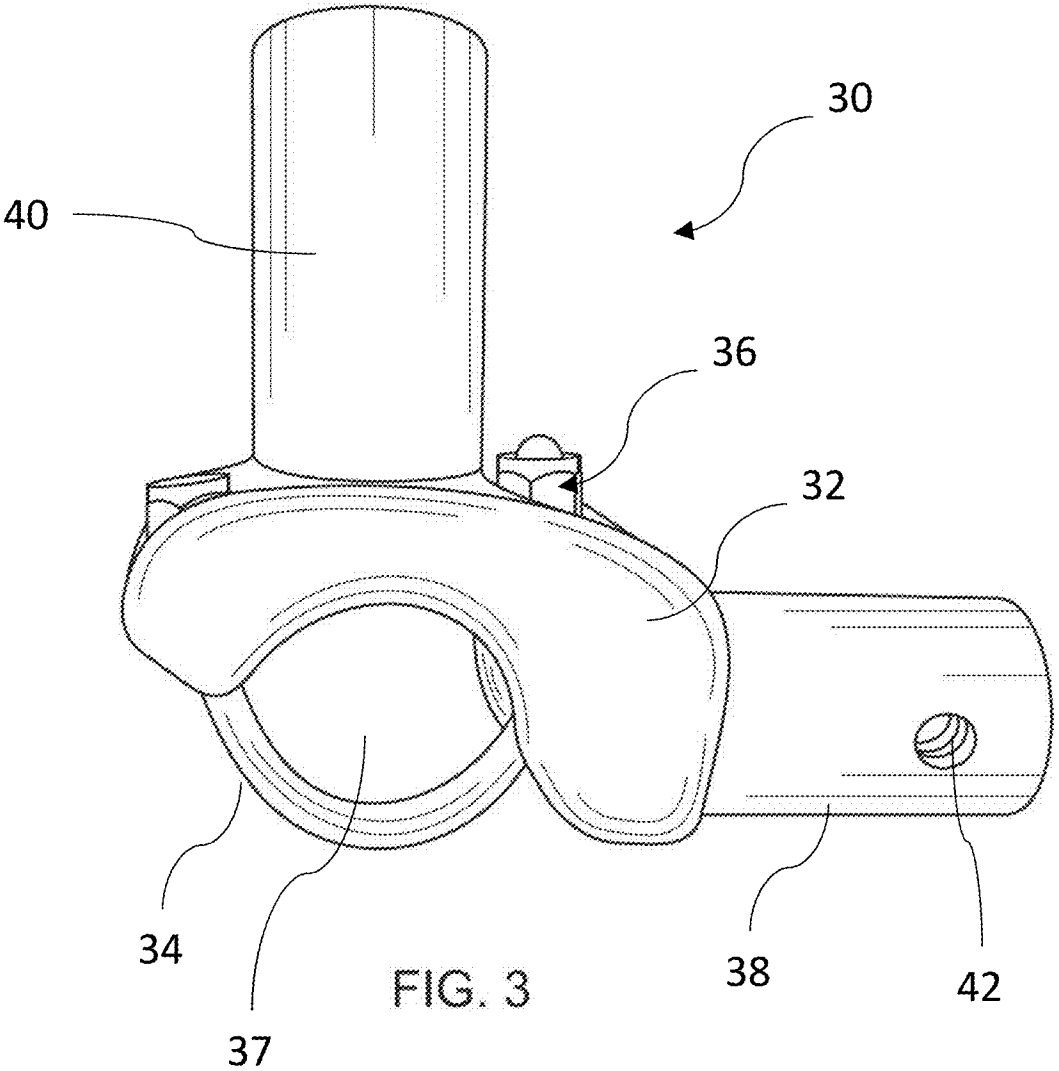
FIG. 3 is a side view of a component of a covering system according to one embodiment of the present disclosure.

FIG. 3 is a side elevation view of an attachment member 30 according to an embodiment of the present disclosure. As shown, the attachment member 30 comprises a central hub portion 32 and is securable to various objects including, for example, round frame members. Specifically, the hub portion 32 comprises a clamp 34. The clamp 34 comprises a curved member that is tightened and secured by at least one fastener 36. The clamp 34 provides a female receiving area 37 at least when secured and allows the member 30 to be secured to an object or pre-existing component. The attachment member 30 further comprises a first male extension 38 and a second male extension 40. The male extensions 38, 40 are operable to receive one or more support members including, for example, the upright support members 6 of FIG. 1. The first and second male extensions 38, 40 comprise apertures 42 to receive a pin, for example, and secure the support members. The first and second male extensions 38, 40 are each operable to receive and secure an additional member. In some embodiments, it is contemplated that the second male extension 40 is operable to support an upright 6 in a position of use wherein the support extends above an object, while the second male extension 38 is operable to receive a support 6 in a storage position when the system is to be stowed.

Figure 4:
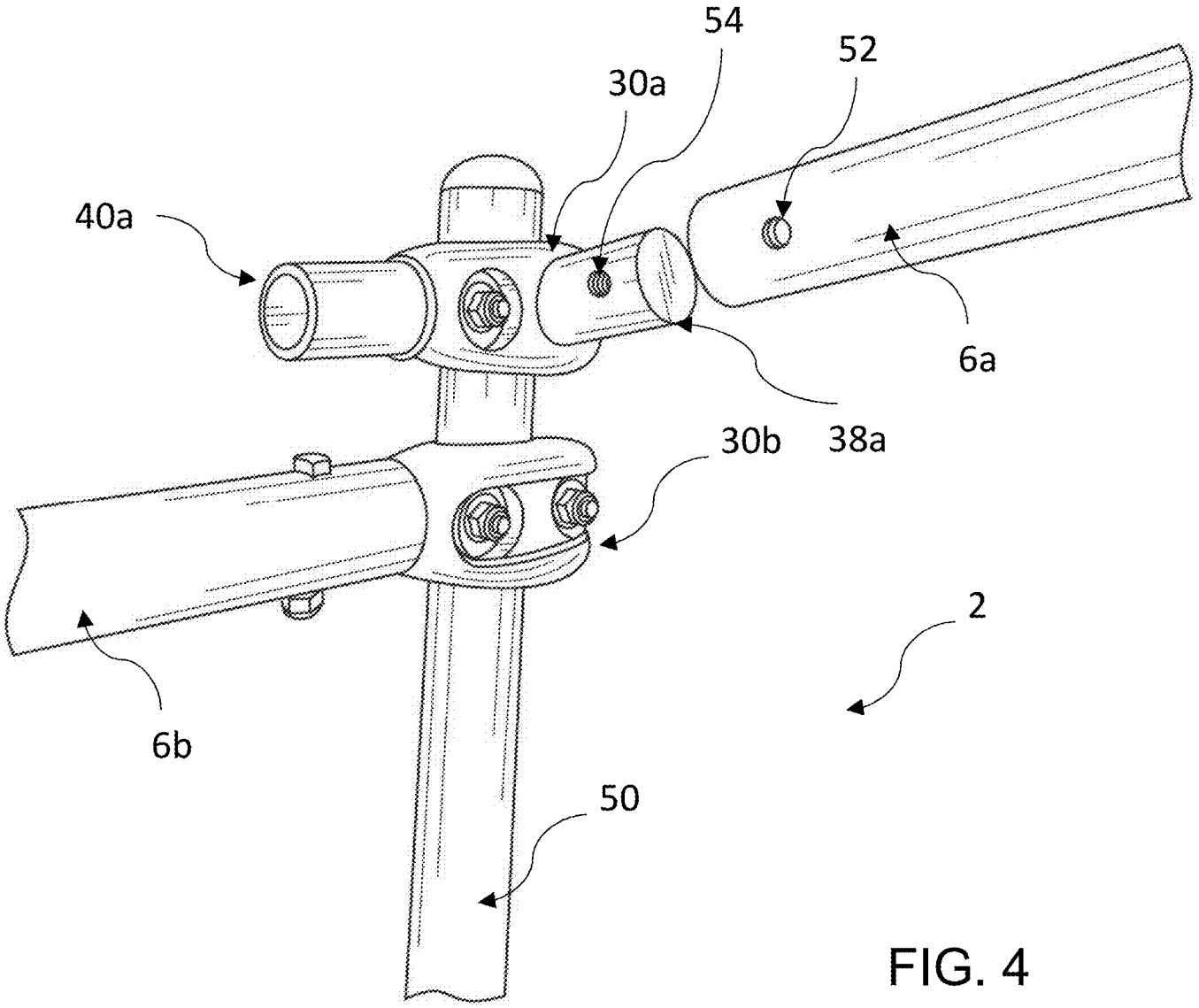
FIG. 4 is a partially exploded view of a portion of a covering system according to one embodiment of the present disclosure.

FIG. 4 is a perspective view of a system 2 according one embodiment of the present disclosure and wherein attachment members 30 are shown relative to additional components including a frame member 50 and members 6*a*, 6*b*. The frame member 50 is contemplated as comprising but is not limited to an internal frame member of a raft. The system of FIG. 4 comprises at least one attachment member 30*a* comprising first and second male extensions 38*a*, 40*a*. A support 6*a* is provided that is operable to be secured to a first male extension 38*a*. A second male extension 40*a* is provided and is contemplated as being useful for or operable to secure the support 6*a* in a storage position when the support is not needed or desired. The support 6 is securable to the attachment member 30*a* by providing a fastener (e.g., a threaded fastener) through an aperture 52 in the support 6 and an aperture 54 in the attachment member 30*a*. The first male extension 38*a* is illustrated as comprising a solid or substantially solid extension, while the second male extension 40*a* comprises a hollow or at least partially hollow extension. Alternatives are contemplated. In some embodiments, both extensions comprise solid or hollow extensions.

A second attachment member 30*b* is provided. The second attachment member 30*b* is secured or clamped to the frame member 50. The second attachment member 30*b* is contemplated as comprising as few as one male extensions to which a support 6*b* is secured. The support 6*b* can be secured to the attachment member 30*b* to stow the support 6*b* and/or to provide a structural member (e.g., a cross-bar for supporting the frame generally).

Figure 5:
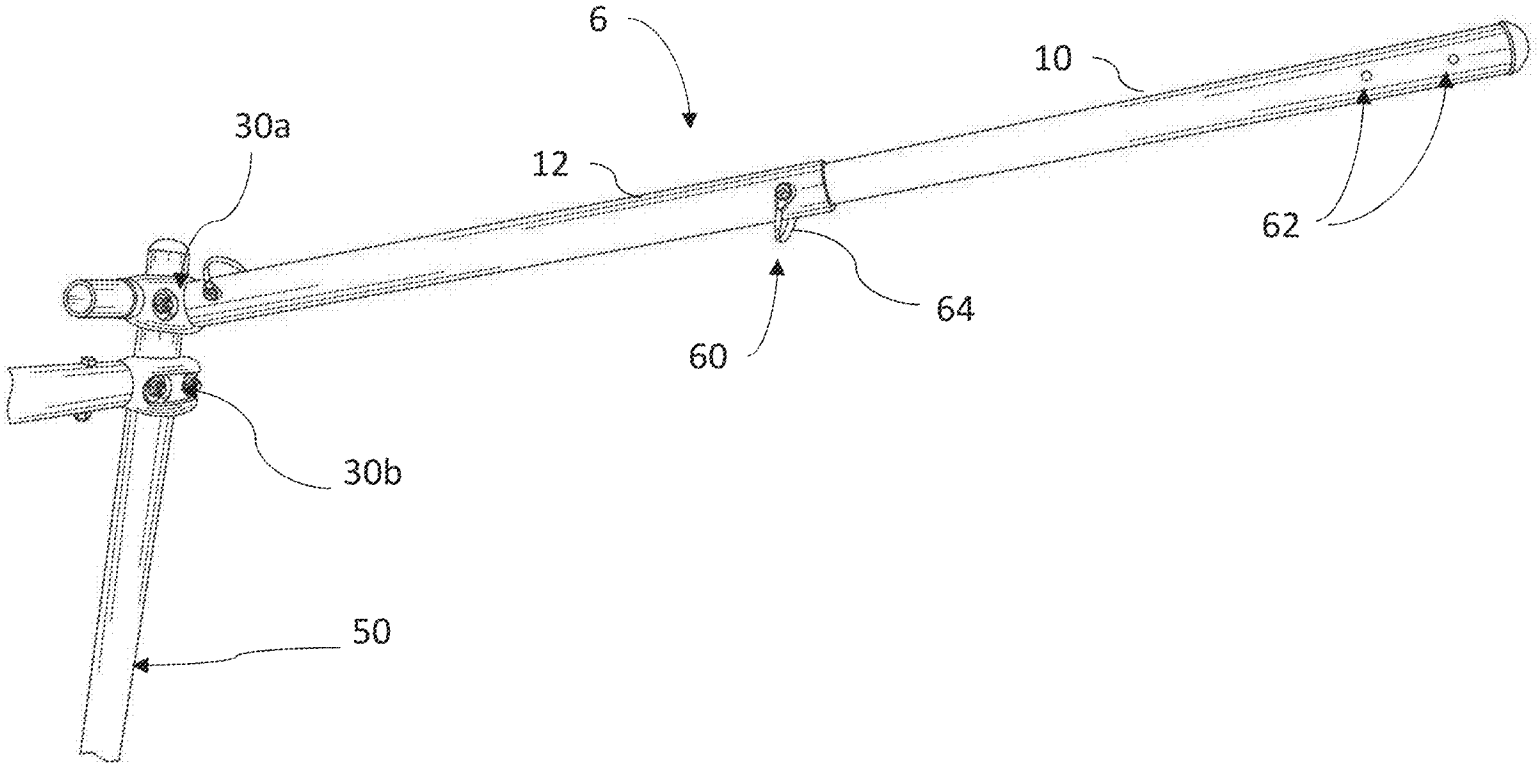
FIG. 5 is a perspective view of a portion of a covering system according to one embodiment of the present disclosure.

FIG. 5 is a perspective view of a portion of a system according to one embodiment of the present disclosure. Various components shown and described with respect to FIGS. 1-4 are labeled in FIG. 5, and the discussion from FIGS. 1-4 is incorporated by reference. As shown in FIG. 5, a first support 6 comprises a first portion 10 and a second portion 12 extending from an attachment member 30*a*. The attachment member is secured to a frame member 50. The first portion 10 is translatable relative to at least the second portion 12. The first portion 10 is secured at a desired relative position by a pin 60 that extends through apertures in the first portion 10 and the second portion 12. As shown in FIG. 5, a plurality of apertures 62 are provided to allow a user to position and secure the first portion 10 in various different positions relative to the second portion 12. The pin 60 is shown as comprising a tether 64. The tether 64 is operable to extend between a first end and a second end of the pin 60 and secure the pin in place. The tether 64 is contemplated as comprising various materials. In some embodiments, the tether 64 comprises a rubber or elastic securing member that is selectively securable to at least one end of the pin such that the pin 60 may be inserted through the first portion and second portion and secured by the tether 64 once the components are assembled. When not provided with a pin 60, apertures 62 of the system are operable to receive and support other objects such as shade coverings, carabiners, etc.

Figure 6:
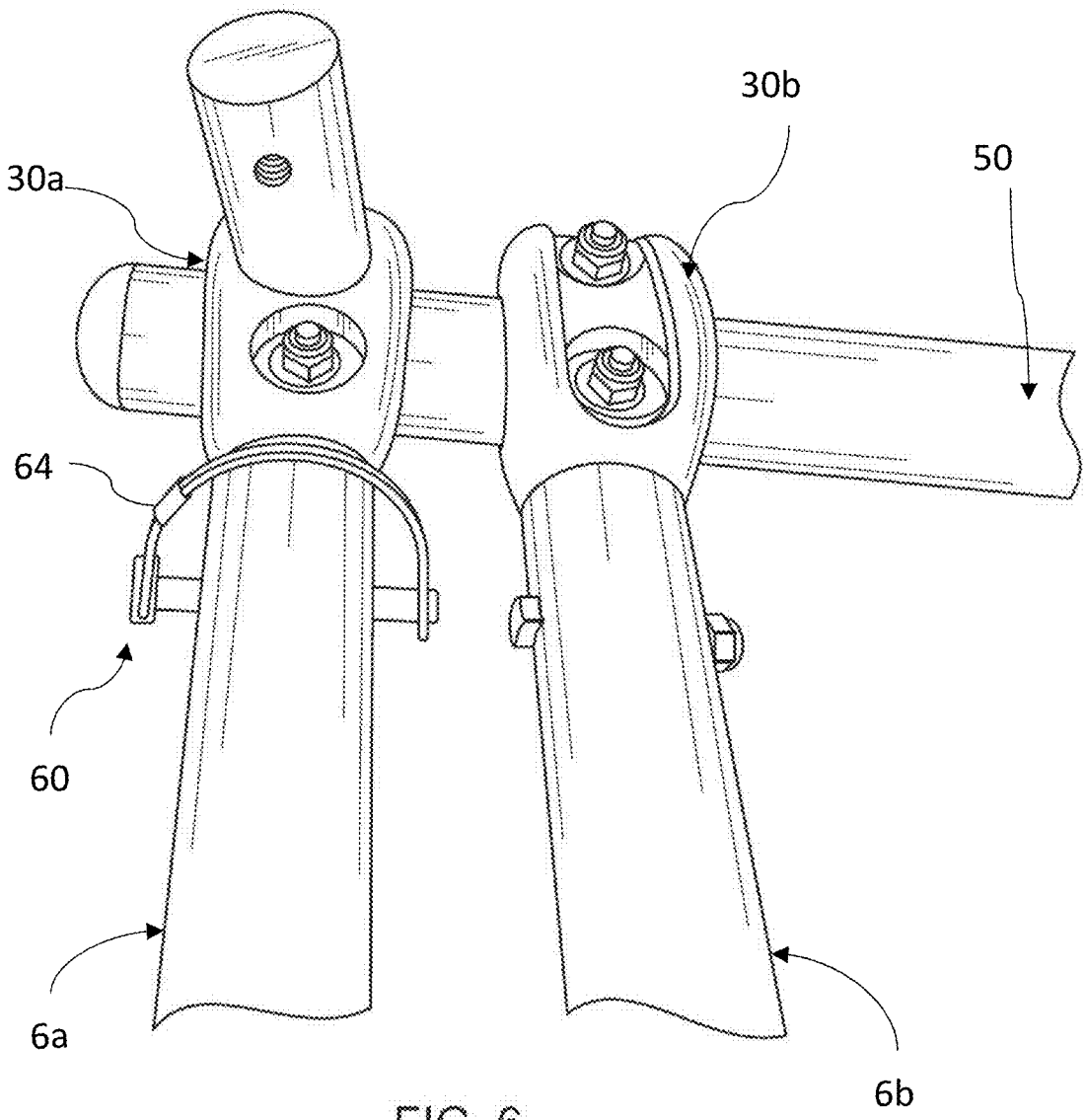
FIG. 6 is a perspective view of a portion of a covering system according to one embodiment of the present disclosure.

FIG. 6 is a perspective view of components of a system according to one embodiment of the present disclosure. As shown in FIG. 6, an attachment member 30*a* is shown with a support 6*a* secured to the attachment member 30*a* in a storage position. The first support 6*a* extends substantially parallel to a second support member 6*b* and both supports 6 extend substantially coplanar with the frame member 50 as opposed to the upwardly extending support position shown in FIG. 1, for example.

Figure 7:
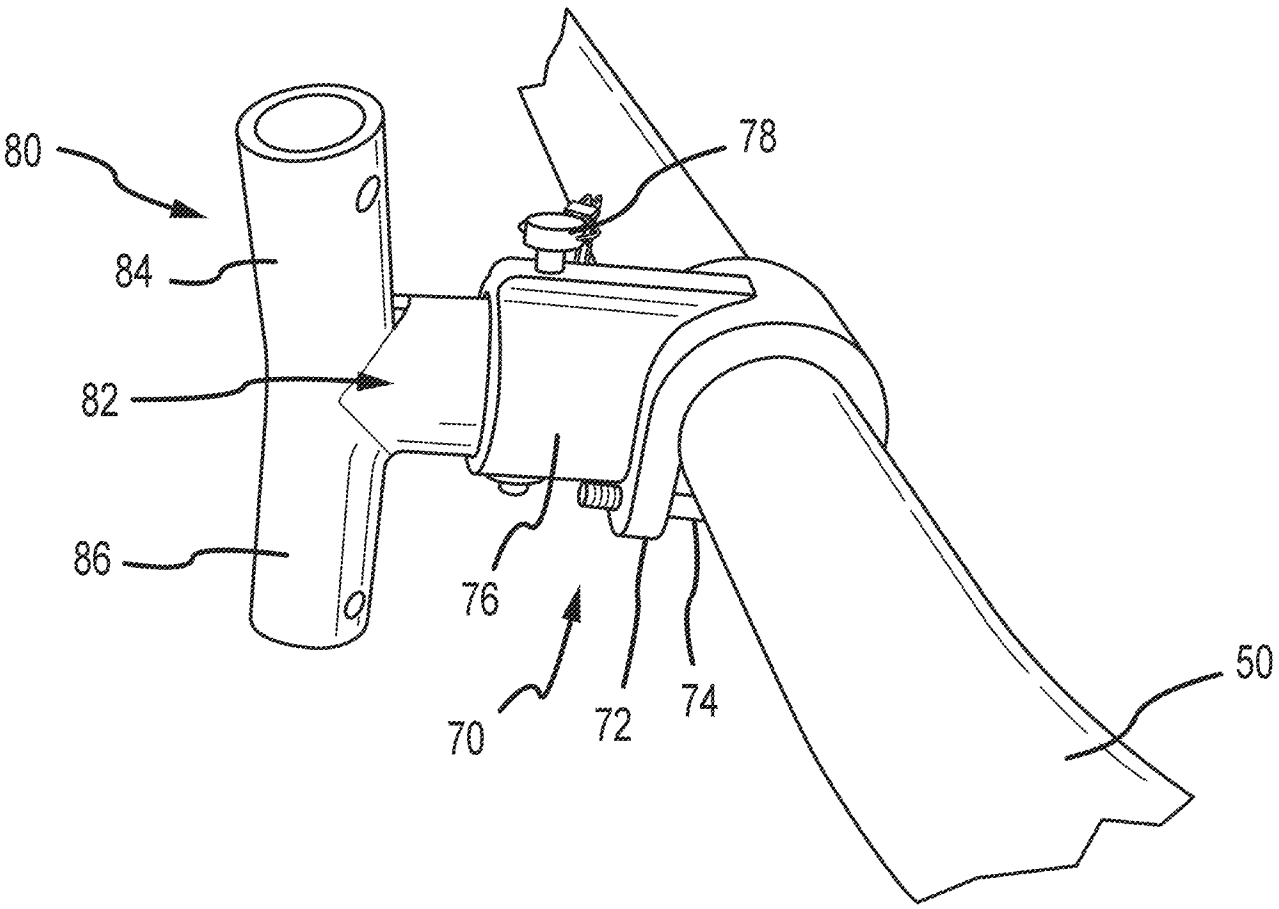
FIG. 7 is a perspective view of portions of a covering system according one embodiment of the present disclosure.

FIG. 7 is a perspective view of components of a covering system attached to a frame member 50. As shown, an attachment member 70 is provided and is secured to the frame member 50. The attachment member 70 of FIG. 7 comprises a C-shaped clamp portion 72 and a fastener 74 for securing the attachment member 70 to a tubular frame member (for example). The attachment member 70 may be provided in various positions but is shown as extending outboard of the frame 70 in FIG. 7. The attachment member 70 comprises an at least partially hollow main body portion 76 with a female aperture. A support member 80 is secured to the attachment member 70 and the frame 50. The support member 80 of the embodiment of FIG. 7 comprises a male extension 82 and first and second attachment portions 84, 86 extending therefrom. The attachment portions 84, 86, which are shown and described in more detail herein, are operable to support various objects at various angles and are rotatable relative to the frame 50 by rotating the support member 80 about a longitudinal axis of the male extension 82. Although the extensions of various embodiments are contemplated as comprising male extensions that are operable to extend into additional components, the present disclosure is not limited to such "male" extensions. Indeed, it is contemplated that attaching portions 84, 86 (for example) comprise extensions with a female aperture for receiving additional components including, for example, upright members for supporting a canopy or cover.

Figure 8:
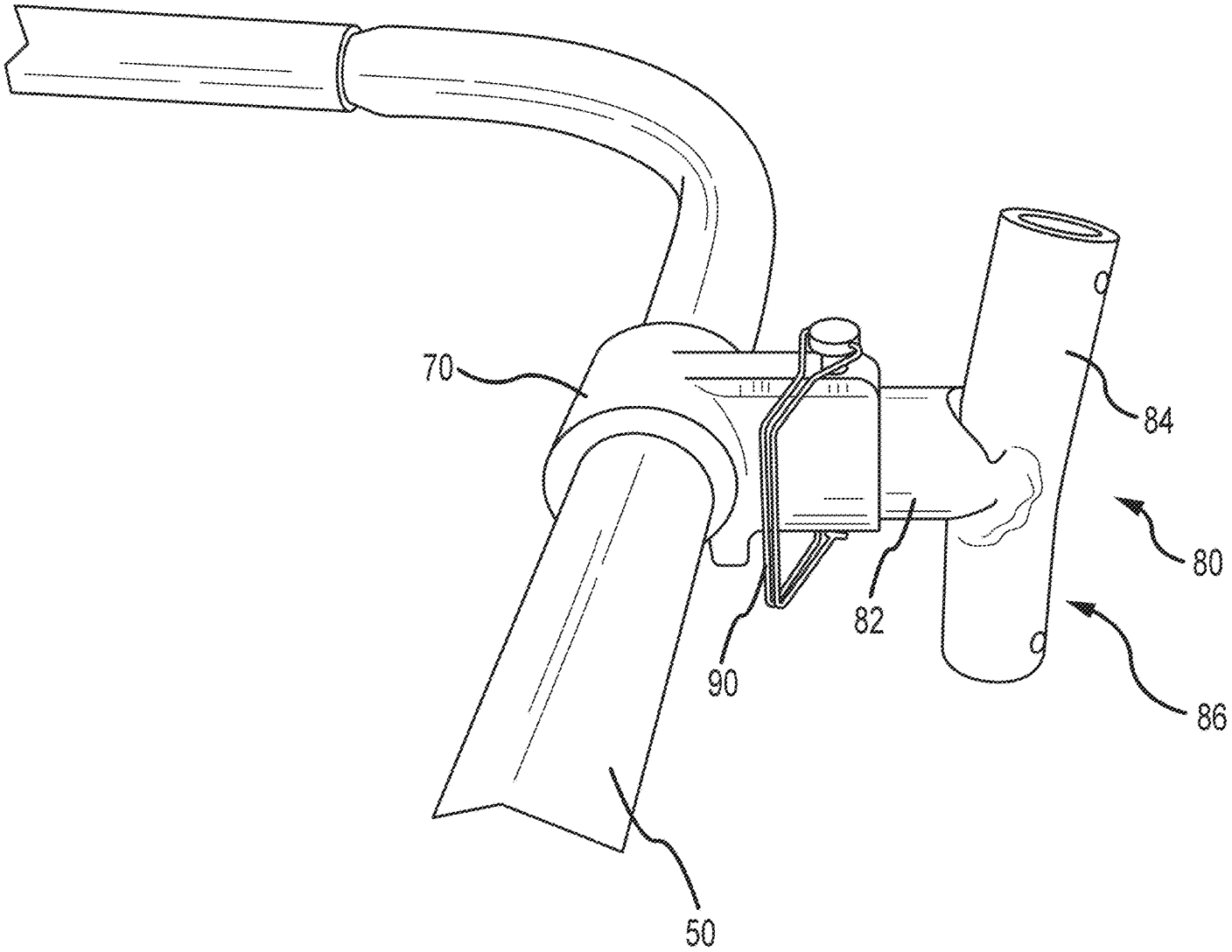
FIG. 8 is a perspective view of portions of a covering system according one embodiment of the present disclosure.

FIG. 8 is a perspective view of the attachment member 70 and support member 80 according to the embodiment of FIG. 7. As shown, the support member 80 is secured to the frame 50 via the attachment member 70. A male extension 82 of the support member 80 extends into the attachment member 70 and the male extension is secured by a pin 90 or clevis. The male extension 82 of the support member 80 is contemplated as comprising a plurality of apertures for selectively securing the support member 80 to the attachment member 70 at a plurality of rotational positions or orientations.

Figure 9:
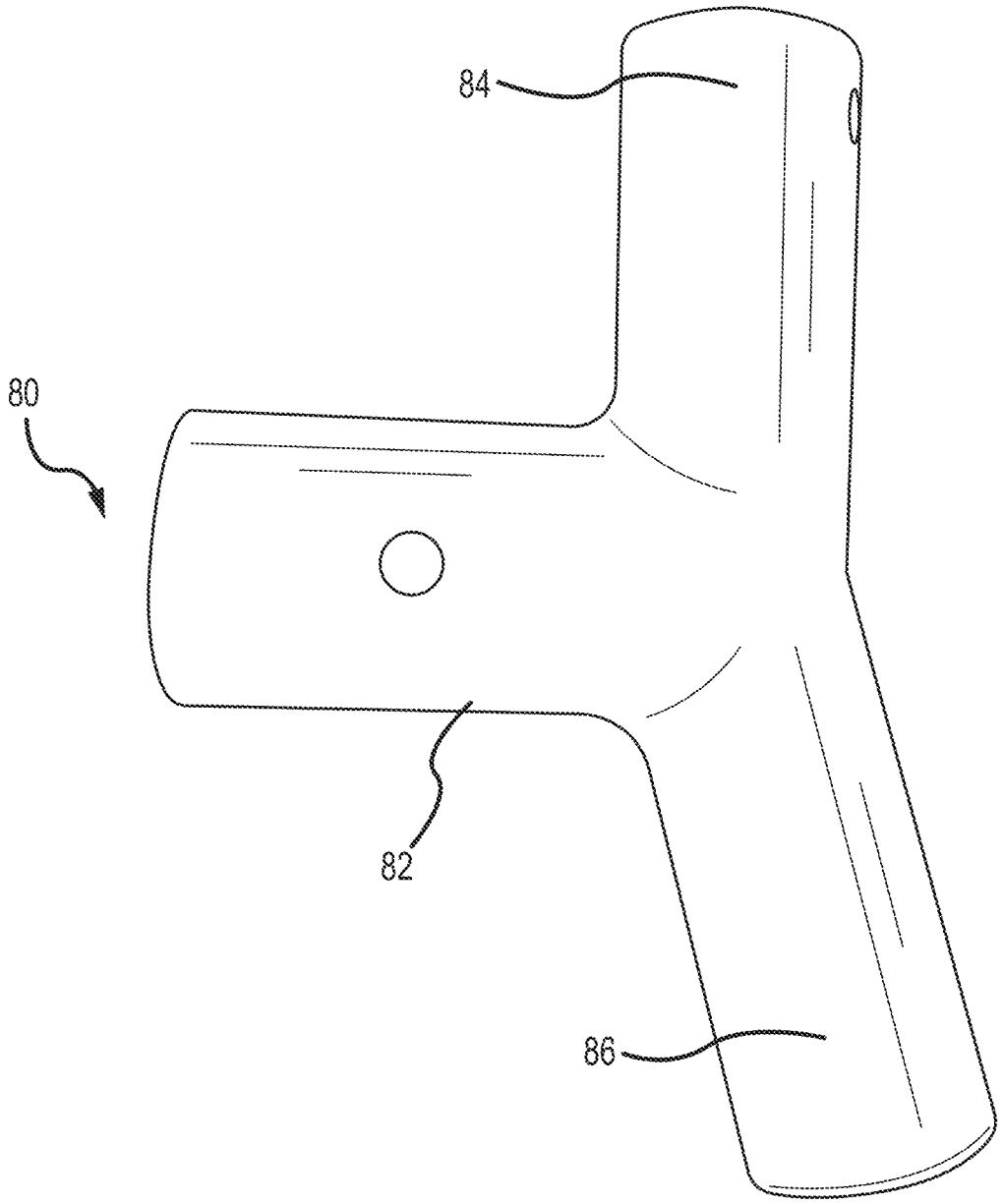
FIG. 9 is a plan view of a component of a covering system according to one embodiment of the present disclosure.

FIG. 9 is a plan view of a support member 80. As shown, the support member 80 comprises a male extension 82 and first and second attachment portions 84, 86. As shown, the first attachment portion 84 extends at an angle relative to the male extension 82 that is approximately a right angle. The second attachment portion 86 extends at a second angle to the male extension 82, and wherein the second angle comprises an oblique angle that is greater than ninety degrees and wherein the second attachment portion 86 is provided at an angle with the first attachment portion. In preferred embodiments, the first and second attachment portions 84, 86 comprise fixed angles wherein the angle of the attachment portion relative to the male extension 82 is fixed. However, the position of the first and second attachment portions 84, 86 are adjustable by rotation of the support member 80 relative to a frame. More specifically, the male extension 82 can be rotated about its longitudinal axis relative to the attachment member 70 and frame, thereby changing the position and angle of the first and second attachment portions 84, 86 relative to a remainder of the system. The first attachment member 84 is contemplated as but is not limited to being provided as a horizontal support member for storing articles. The second attachment member 86 is contemplated as but is not limited to being provided as an upright support for supporting a shade element or similar article. It will be recognized, however, that no limitation with respect to these intended uses is provided. For example, the first attachment member 84 can be provided in an upright position to provide a support for a shade that extends substantially perpendicular to a frame member.

Figure 10:
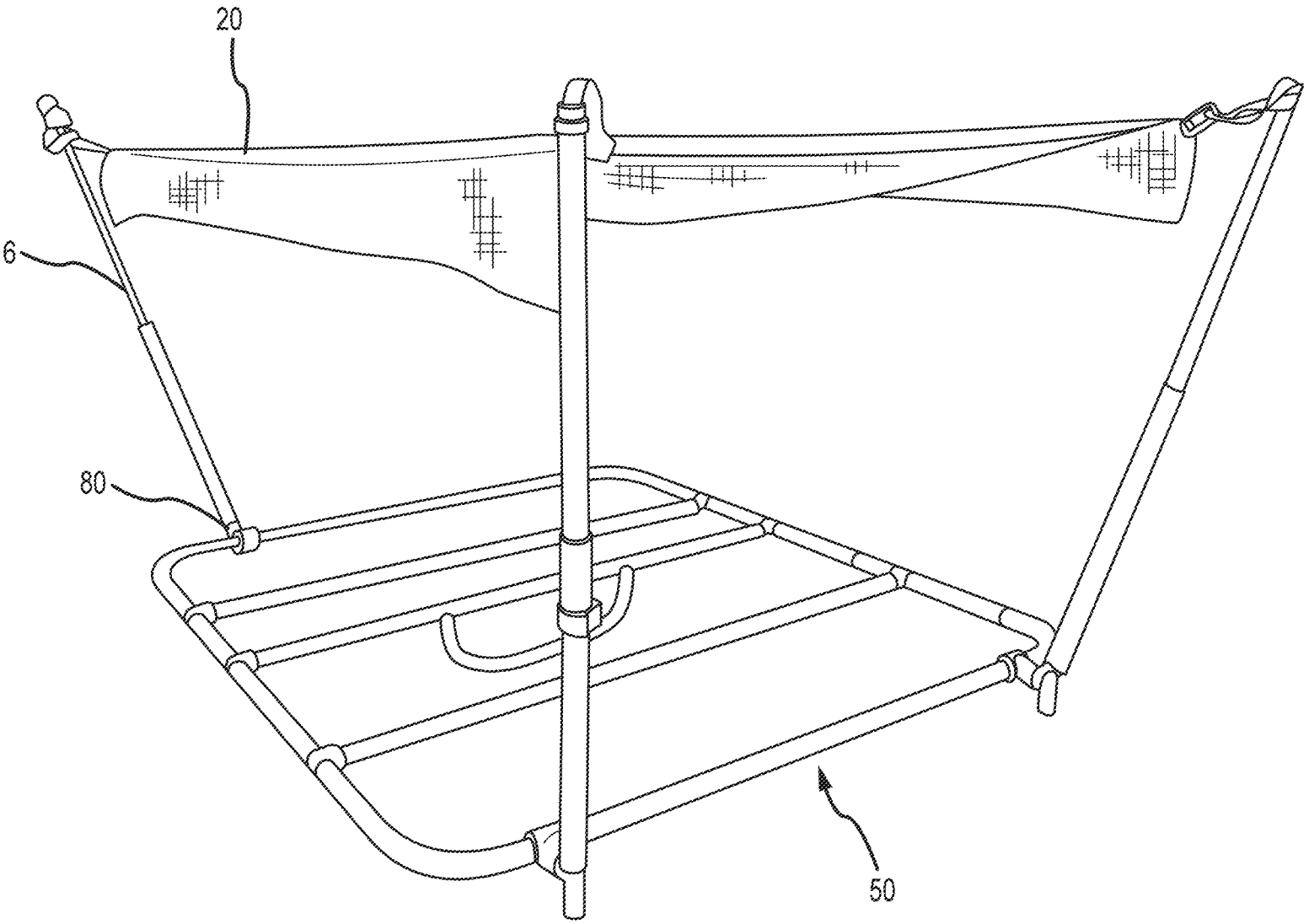
FIG. 10 is perspective view of a covering system according to one embodiment of the present disclosure.

FIG. 10 is a perspective view of a system 2 according to one embodiment of the present disclosure. As shown, the system 2 comprises a shading system with a plurality of upright supports 6 extending from a frame member 50. The supports 6 are secured to the frame 50 by support members 80 as shown in FIGS. 7 and 8 (for example). The support members 80 are provided and positioned to extend outboard of the frame member 50. The second attachment portions 86 are provided in an upright position, and wherein the second attachment portions 86 extend at an upward and outward angle such that the supports 6 extend upward and outboard from a center of the frame member.

Although not shown in FIG. 10, the support members 80 are operable to be provided in a second position. The second position comprises a storage position wherein the attachment member 70 is rotated approximately ninety degrees such that the first attachment member 84 extends substantially parallel to the lateral frame members. Additionally, the attachment members 70 can be rotated and/or repositioned such that that they extend inboard of the frame member (or extend in another direction) based on user preference.

Figure 11:
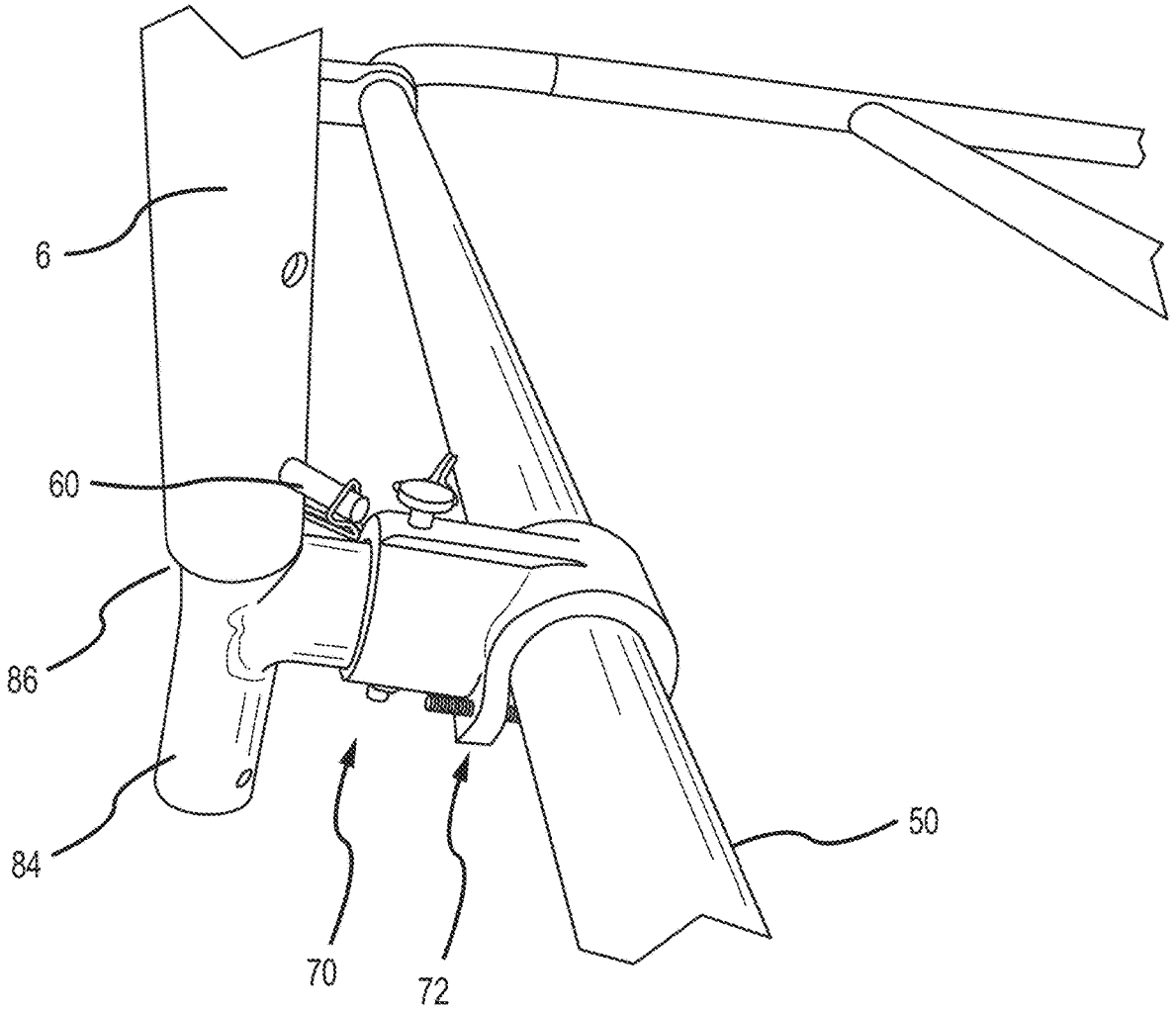
FIG. 11 is a perspective view of portions of a covering system according one embodiment of the present disclosure.
Figure 12:
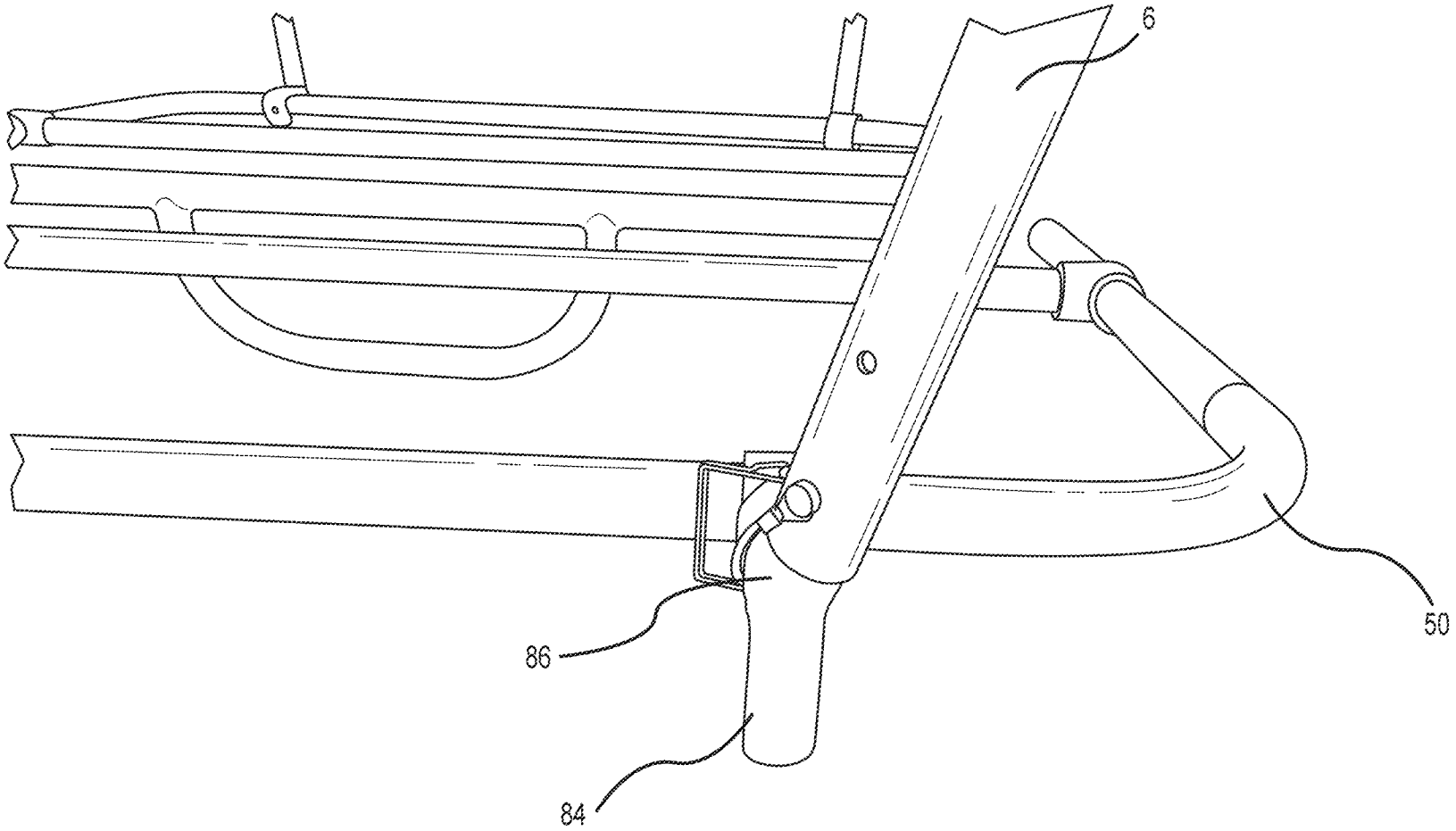
FIG. 12 is a perspective view of portions of a covering system according one embodiment of the present disclosure.

FIGS. 11-12 are detailed perspective views of a system according to one embodiment of the present disclosure. As shown, a frame member 50 is provided. An attachment member 70 is provided and is shown in more detail in FIG. 7. A support member 80 is secured to the attachment member 70, and the support member 80 comprises first and second attachment portions 84, 86. The support member 6 is contemplated as comprising a support member for a shading cover or various other articles. A pin 60 is provided to secure the support 6 to the second attachment portion 86. In various embodiments, it is contemplated that a system is provided comprising four attachment members 70 and four support members 80. However, alternative embodiments are contemplated wherein as few as one attachment member 70 and one support member 80 are provided to support a single element (e.g., a light or flagpole). Further embodiments contemplate the provision of more than four supports for larger vessels or where a large amount of weight is to be supported (for example).

Figure 13:
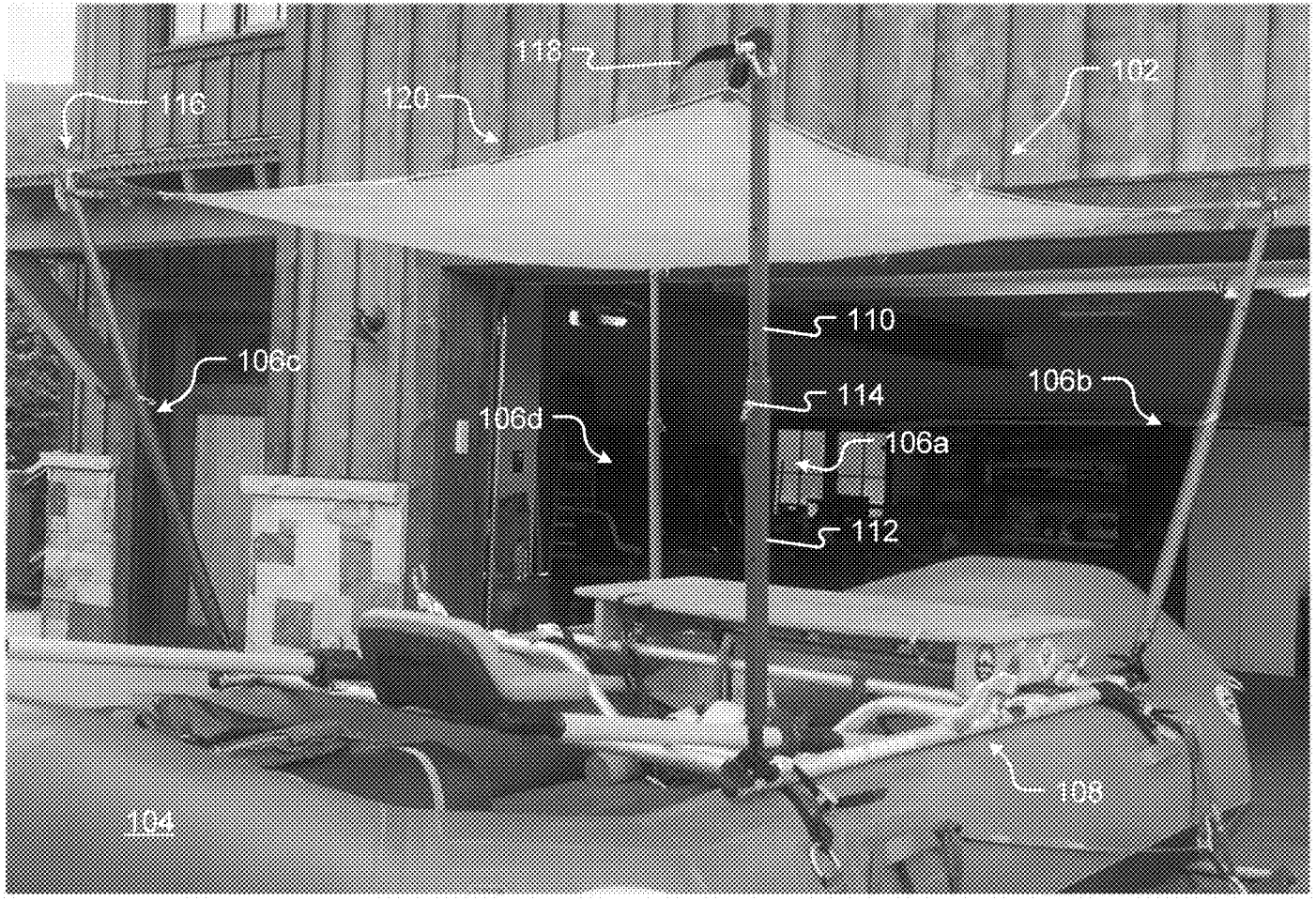
FIG. 13 is a perspective view of a covering system according to one embodiment of the present disclosure shown in combination with a raft.

FIG. 13 is a perspective view of a shade and covering system 102 in a constructed or erected arrangement, according to one embodiment of the present disclosure. As shown, the system 102 is provided in combination with a watercraft 104 which is depicted as a raft in FIG. 13. It will be recognized, however, that systems of the present disclosure can be provided with various objects and devices including different watercraft, fixed objects, semi-fixed objects (e.g., tables), and the like. Accordingly, the watercraft 104 of FIG. 13 is shown for illustrative purposes and no limitation is provided herewith with respect to the intended use of the system 102. It is noted that the embodiments of system 2 and/or the watercraft 4 as described with respect to FIGS. 1-12 may be applicable to and/or combinable with the embodiments of system 102 and/or the watercraft 104 as described with respect to FIGS. 13-22, and vice versa, unless otherwise noted.

As shown in FIG. 13, the system 102 comprises a plurality of upright supports (or support members) 106, including supports 106*a*, 106*b*, 106*c*, 106*d*. The upright supports 106 are contemplated as being selectively connected to a pre-existing frame 108 of the watercraft 104 (for example) or other pre-existing component. The connection between the upright supports 106 and the frame 108 of the watercraft 104 is not detailed in FIG. 13 and will be described later. The upright supports 106 of FIG. 13 are contemplated as comprising telescoping members wherein a first portion 110 and a second portion 112 of each of the supports 106 are selectively translatable relative to one another between a raised position and a lowered position and can be secured in a plurality of different relative positions. The first portion 110 and second portion 112 are selectively securable via pins 114 (e.g., either alone or with cotter pins, tethers, or the like) operable to extend through at least a portion of the first members and the second members. For example, where tethers are used, the tethers may be similar to the tethers 64 as described throughout the present disclosure. In addition, the tethers may be coupled to the pins 114 at a first position on the pin 114 and operable to pivot between a closed position where the tether engages the pin 114 at a second position on the pin 114 and an open position where the tether does not engage the pin 114 at the second position, similar to a safety pin or clevis.

The upright supports 106 are contemplated as comprising supports that extend above the watercraft 104. Distal ends 116 of the supports 106 are contemplated as comprising connection points for a covering (for example). It is also contemplated, however, that frame components including upright supports 106 and related connection members are suitable for supporting various objects including, for example, fishing rods, flags, lights, storage accessories, speakers, drink holders, and sails.

Figure 14:
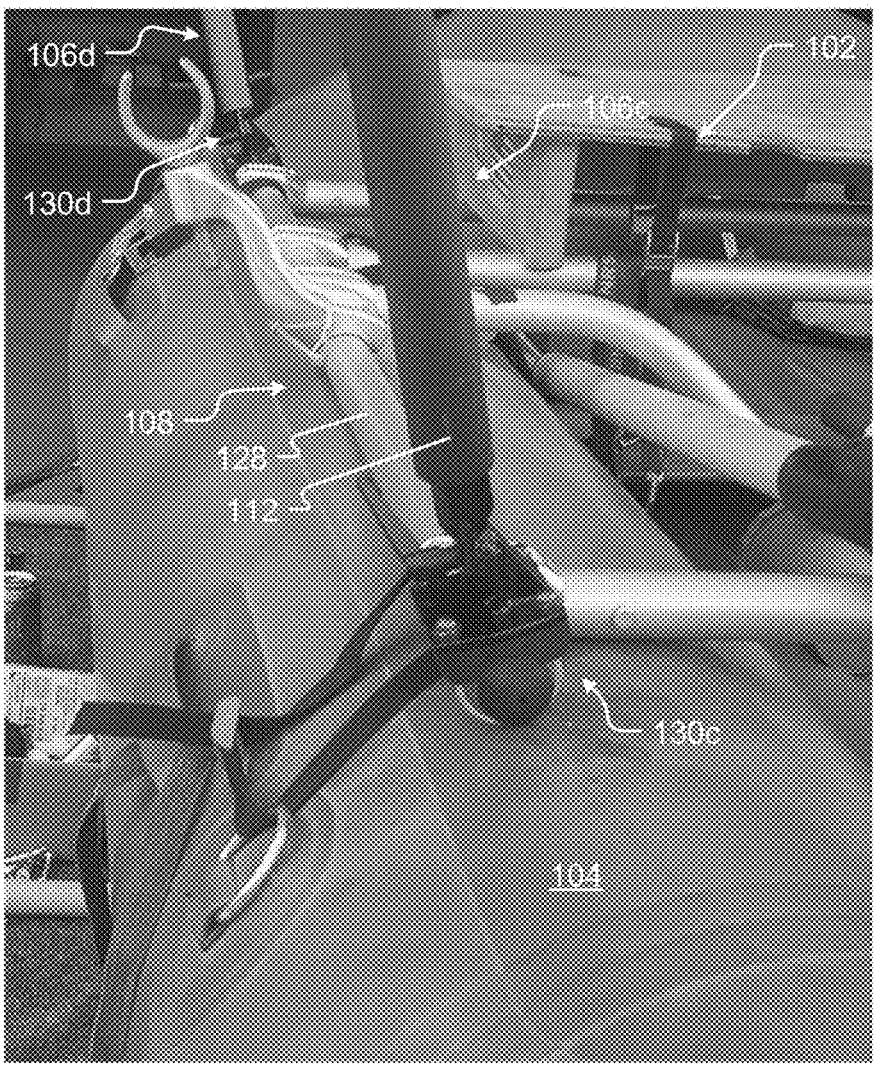
FIG. 14 is a perspective view of a portion of a covering system according to one embodiment of the present disclosure shown in combination with a raft.
Figure 15:
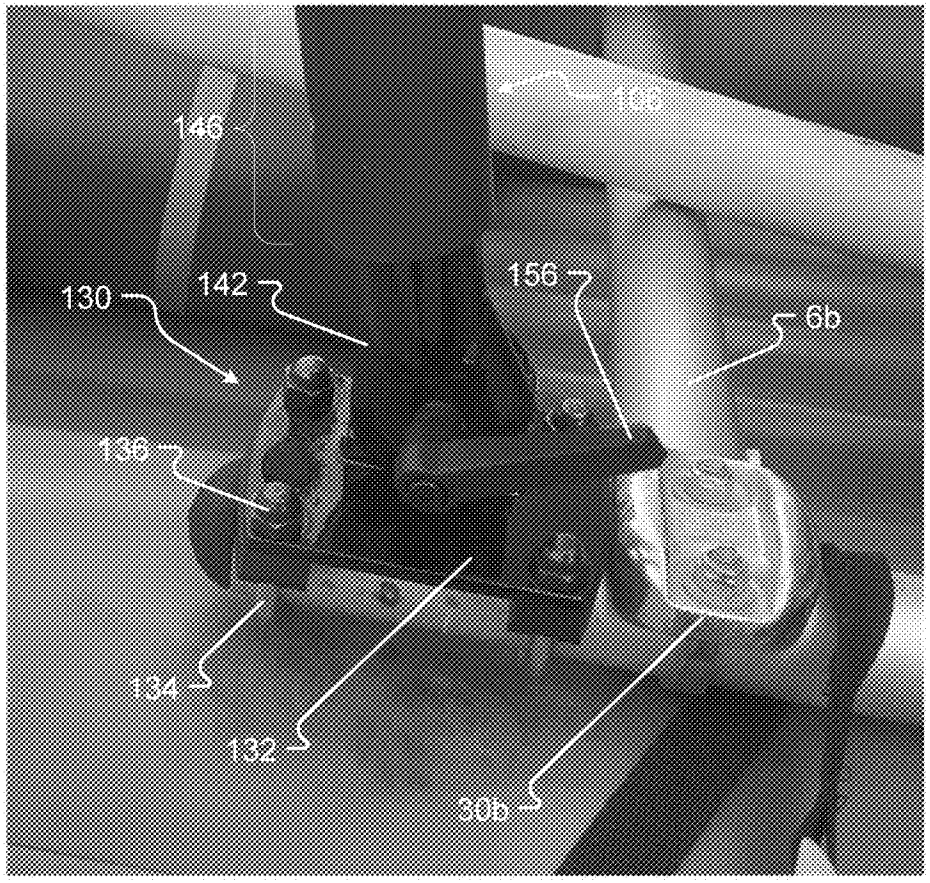
FIG. 15 is a perspective view of a portion of a covering system according to one embodiment of the present disclosure.
Figure 16:
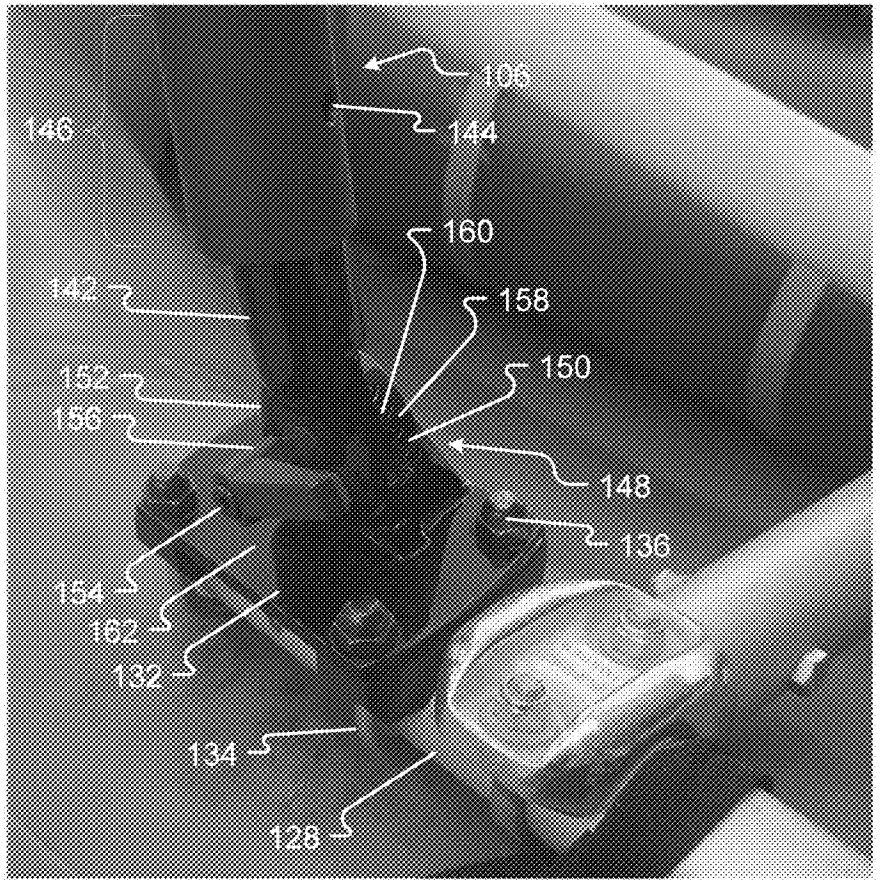
FIG. 16 is a perspective view of a portion of a covering system according to one embodiment of the present disclosure.
Figure 17:
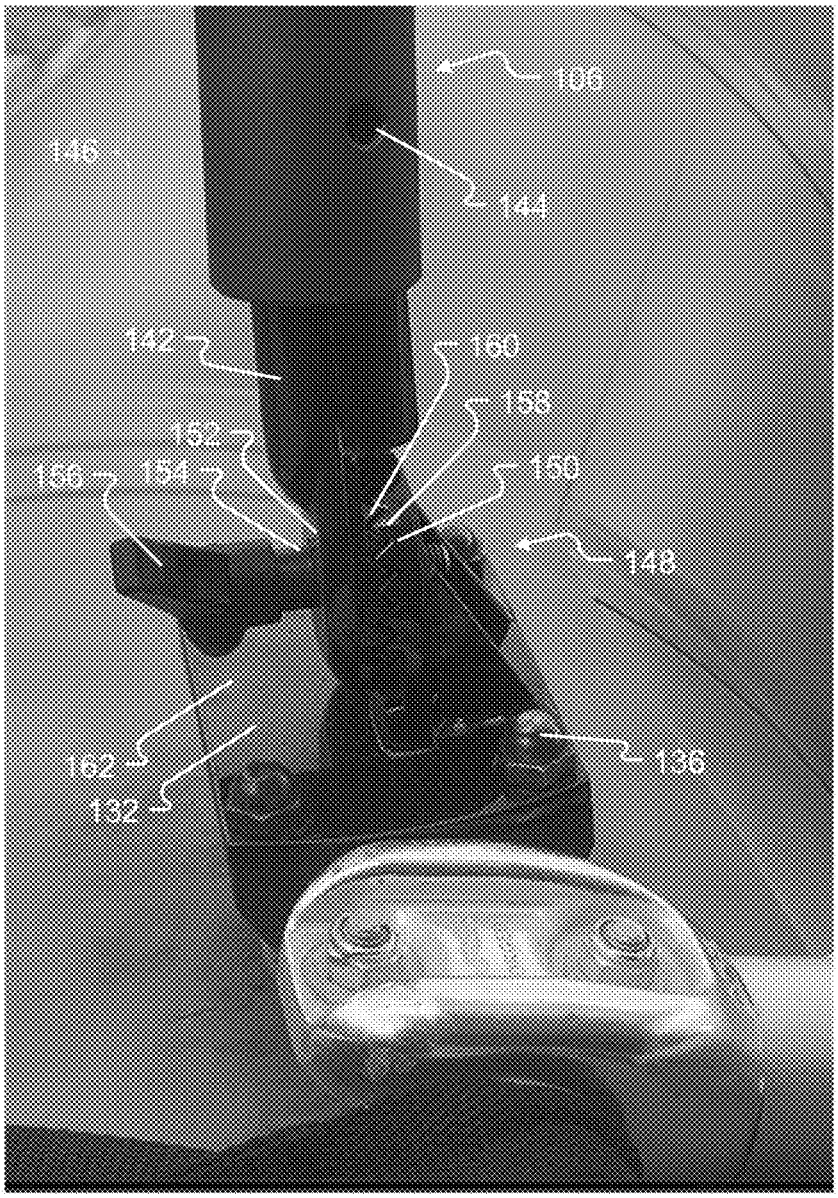
FIG. 17 is a perspective view of a portion of a covering system according to one embodiment of the present disclosure.
Figure 18:
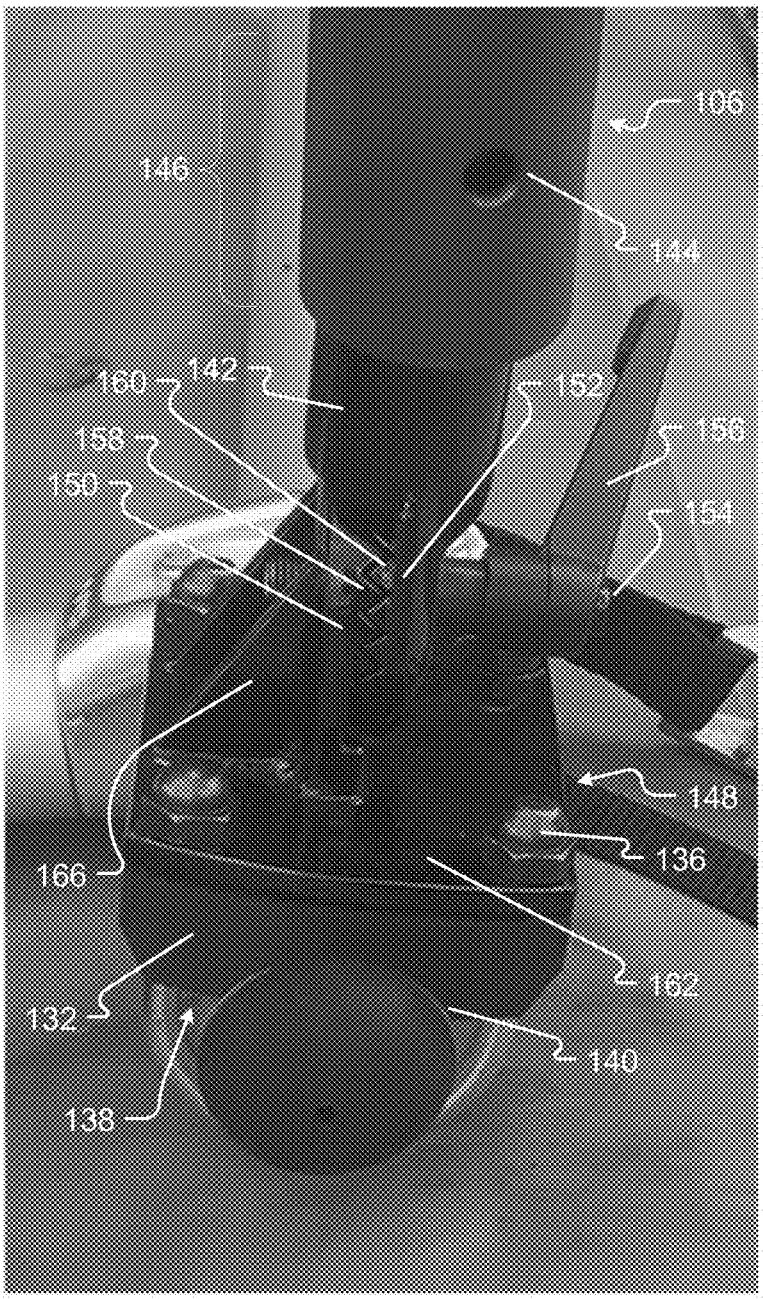
FIG. 18 is a perspective view of a portion of a covering system according to one embodiment of the present disclosure.

It is noted herein that the support 106 including the exemplary first portion 110 and the second portion 112 may be used in combination with any or all of the supports 6 including exemplary first section 10 and second section 12 as described throughout the present disclosure. For example, although FIGS. 13-14 illustrate the support 106 with exemplary sections 108, 110 secured together with pins 114, it is noted that any of the supports 6 with sections 10, 12 and coupling pins 60 and tethers 64. In addition, it is noted the sections 110, 112 may include apertures similar to the plurality of apertures 62 in the first portion 10 of the support 6 (e.g., as illustrated in FIG. 5), to secure the first portion 110 and the second portion 112 together when the support 106 is collapsed and/or to couple to attachments such as a covering 120, hooks or eyebolts, carabiners, or the like when in the support 106 is extended. In this regard, the systems 2 and 102 as described throughout the present disclosure may include components that are combinable into a single system, without departing from the scope of the present disclosure.

Also as shown in FIG. 13, connecting straps 118 and a cover member or covering 120 is provided. The cover member 120 extends between and is connected to at least some of the plurality of upright supports 106 via the connecting straps 118 to span an area over the watercraft 104 and provide covering and shade thereto. Although four upright supports 106 and a generally rectangular cover 120 are shown in FIG. 13, the present disclosure is not limited to such arrangements. Greater or fewer than four upright supports are contemplated, as are different shaped coverings 120 and/or different types of connecting straps 118. The covering 120 is contemplated as comprising various materials. For example, the covering 120 may comprise a lightweight porous member that is suitable for providing shade and sun protection including, but not limited to, a textile canopy member. The covering 120 is also contemplated as comprising a water resistant or waterproof covering to repel sun and water. The connecting straps 118 are contemplated as any material able to be tied or tightened including woven nylon, rope, or paracord, either with or without tightening components such as buckles or ratchets. In other embodiments, the covering 120 may couple directly to the upright supports 106 and without the intervening or intermediate connecting straps 118, without departing from the scope of the present disclosure.

Embodiments of the present disclosure provide support structures and connection members that facilitate the support of a shade or cover member 120 in various positions. As shown and described herein, various components of the present disclosure allow for positioning and repositioning of a cover by allowing selective rotation of the supports 106 (or support members 106) as well as selective expansion and contraction of the supports 106.

FIG. 14 is a perspective view of a portion of the system 102 and watercraft 104 according to the embodiment of FIG. 13. The uprights 106*c*, 106*d* are coupled to frame members 128 of the frame 108 via attachment members 130*c*, 130*d*. In one non-limiting example, the second portion 112 of each of the uprights 106*c*, 106*d* are coupled to a frame member 128 of the frame 108 via respective attachment members 130*c*, 130*d*. It is noted the attachment members 130*c*, 130*d* for the supports 106*c*, 106*d* may be coupled to the same frame member 128 that runs parallel at a 0 degree) (° angle, or at a non-zero degree angle such as, but not limited to, a perpendicular angle, to the length of the watercraft 104. In addition, the attachment members 130*c*, 130*d* for the supports 106*c*, 106*d* may be coupled to different frame members 128.

Referring generally to FIGS. 15-19, the attachment member 130 as shown comprises a hub portion 132 that is securable to various objects including, for example, frame members 128. Specifically, the hub portion 132 comprises at least one clamp 134. In one non-limiting example, the at least one clamp 134 comprises a curved member that is tightened and secured by at least one corresponding fastener 136. The at least one clamp 134 provides a receiving area 138 (e.g., at least when the fasteners 136 are tightened) that allows the member 130 to be secured to an object or pre-existing component (e.g., such as a frame member 128). In some embodiments, the at least one clamp 134 is a U-clamp or U-bracket that passes through or otherwise engages with the hub portion 132 in two locations, where each location has a fastener 136 such as a nut. In other embodiments, the at least one clamp 134 is a pivoted assembly with a pivot or hinge on a first end at a first location on the hub portion 132 and a portion on a second end that connects to a fastener 136 and is operable to slide into a groove at a second location on the hub portion 132 when the fastener 136 is loosened, but is not operable to be removed from the groove on the hub portion 132 when the fastener 136 is tightened.

In embodiments, the hub portion 132 includes one or more sections 140 that are contoured to conform to the frame members 128 of the frame 108, other components of the watercraft 104, or other pre-existing components to which the attachment member 130 couples. For example, where the frame member 128 includes a cross-section along its length that is substantially circular or elliptic, the hub portion 132 may include a section 140 with a complementary arcuate surface or cut-out that is operable to receive the frame member 128. Similarly, where the frame member 128 includes a cross-section along its length that is rectangular, the hub portion 132 may include a section 140 with a complementary cut-out with a corresponding width and/or height that is operable to receive the frame member 128. Further, the section 140 may be any complementary cut-out that is contoured to conform to a polygonal cross-section along the length of the frame member 128, other components of the watercraft 104, or other pre-existing components to which the attachment member 130 couples. In this regard, the frame member 128 may be at least partially inserted, embedded, or otherwise positioned within the hub portion 132, creating a more compact configuration and more secure configuration than if the hub portion 132 sat on or proximate to a surface of the frame member 128 without the conforming surfaces and/or cut-outs.

It is noted herein that the attachment member 130 may be used in combination with any or all of the attachment members 30*a*, 30*b*, 70, the support member 80, and/or the supports 6*a*, 6*b* as described throughout the present disclosure. For example, FIGS. 15-19 illustrate the attachment member 130 and the attachment member 30*b* both secured to a frame member 128, where the attachment member 130 is coupled to a support 106 and the attachment member 30*b* is coupled to a support 6*b*. In addition, it is noted that aspects of the frame member 50 may be applicable to frame member 128, and vice versa, as described throughout the present disclosure. In this regard, the systems 2 and 102 as described throughout the present disclosure may include components that are combinable into a single system, without departing from the scope of the present disclosure.

The attachment member 130 further comprises an extension 142. The extension 142 is operable to receive portions of the one or more support members 106 including, for example, the second portion 112 of the upright support members 106 of FIG. 13. The support member 106 is couplable and/or securable to the extension 142 via an aperture 144. For example, the aperture 144 may be operable to receive a pin that engages a corresponding aperture or detent in the extension 142. By way of another example, the aperture 144 may be operable to receive a fastener (e.g., a screw with a knob) that engages an exterior surface of the extension 142 and forces adjacent surfaces of the extension 142 and the support member 106 to make contact. In general, the aperture 144 may be operable to receive any coupler or portion of an interlocking assembly formed from components shared by the extension 142 and the support member 106.

It is noted that FIGS. 15-19 generally illustrate that the extension 142 is a male extension with a first diameter that is operable to receive a corresponding female coupler section 146 on the support 106 having a second diameter that is greater than the first diameter. However, in other embodiments the extension 142 is a female extension with a first diameter that is operable to receive a corresponding male coupler 146 on the support 106 having a second diameter that is less than the first diameter, without departing from the scope of the present disclosure. Further, in other embodiments the extension 142 and the support 106 each include male ends that are insertable into corresponding female ends of a splice coupler or bracket, without departing from the scope of the present disclosure. Further, in other embodiments the extension 142 and the support 104 are each female ends that are operable to receive corresponding male ends of a splice coupler or bracket, without departing from the scope of the present disclosure. In general, the extension 142 and the support 106 are couplable by any means that allow for the joining of the extension 142 and the support 106. It is noted that male versions of the extension 142, the coupler section 146 of the support 106, and/or the intervening splice coupler or bracket as described herein may be solid, partially solid, partially hollow, or hollow without departing from the scope of the present disclosure.

In embodiments, the attachment member 130 includes an interlocking assembly 148. The interlocking assembly 148 includes a first angle plate 150 and a second angle plate 152. For example, the first angle plate 150 may extend from the hub portion 132, being either integrated with the hub portion 132 (e.g., fabricated as a single component) or attached to the hub portion 132 (e.g., via welding, affixing with an adhesive, or the like). By way of another example, the second angle plate 152 may extend from the extension 142, being either integrated with the extension 142 (e.g., fabricated as a single component) or attached to the extension 142 (e.g., via welding, affixing with an adhesive, or the like).

The first angle plate 150 and the second angle plate 152 are coupled together via a fastener 154, such that the second angle plate 152 is rotatable relative to the first angle plate 150. The second angle plate 152 is rotatable relative to the first angle plate 150 about an axis through the fastener 154. In this regard, the extension 142 with the second angle plate 152 is positionable at a desired or predetermined angle (e.g., between 0° and 180°, or the like) relative to the hub portion 132 with the first angle plate 150 when the fastener 154 is in the first locked configuration, and the extension 142 is secured at the desired or predetermined angle relative to the hub portion 132 when the fastener 154 is in the second locked configuration.

The fastener 154 may be actuatable between a first locked configuration and a second unlocked configuration via a handle 156 coupled to the fastener 154, such that rotating the handle 156 causes the second angle plate 152 and the first angle plate 150 to engage and/or disengage. For example, the handle 156 may be rotatable between a first position and a second position, with one or more transition or intermediate positions between the first position and the second position, with the first position corresponding to the first locked configuration (or a "tightened" or "tight" configuration) and the second position corresponding to the second unlocked configuration (or a "loosened" or "loose" configuration). For instance, rotating the handle 156 at least a half, at least a full, or more than one rotation to actuate between the first position and the second position via the one or more transition or intermediate positions causes the fastener to allow for the locking and/or unlocking of the second angle plate 152 and the first angle plate 150.

In other embodiments, however, the fastener 154 may be a component of a button or toggle assembly (e.g., spring-loaded), such that activating the button assembly causes the first angle plate 150 and the second angle plate 152 to disengage and allow for rotation of the second angle plate 152 relative to the first angle plate 150. In these embodiments, the handle 156 may be not necessary.

In some embodiments, the first angle plate 150 includes a first interlocking component 158 that is operable to engage a second interlocking component 160 of the second angle plate 152. The second angle plate 152 may be fixed at a particular angle relative to the first angle plate 150 via the second interlocking component 160 and the first interlocking component 158. When the fastener 154 is in the first locked configuration, the interlocking components 158, 160 engage to secure the extension 142 with the second angle plate 152 at the desired or predetermined angle relative to the hub portion 132 with the first angle plate 150. When the fastener 154 is in the second unlocked configuration, the interlocking components 158, 160 disengage to allow the extension 142 to rotate relative to the hub portion 132.

In one non-limiting example, the first interlocking component 158 of the first angle plate 150 may include a first set of teeth that mesh with a second set of teeth of the second angle plate 152 that forms the second interlocking component 160. When the fastener 154 is in the first locked configuration, the meshing of the sets of teeth 158, 160 prevent rotation of the extension 142 with the second angle plate 152 relative to the hub portion 132 with the first angle plate 150 about the axis through the fastener 154. When the fastener 154 is in the second unlocked configuration, the set of teeth 160 do not mesh (e.g., are separated and/or disengaged) and the extension 142 is able to rotate freely relative to the hub portion 132 about the axis through the fastener 154. For instance, the set of teeth 160 may be displaced outward (e.g., separated) from the set of teeth 158 at least a distance necessary to allow the extension 142 to rotate freely relative to the hub portion 132.

Although embodiments of the present disclosure are directed to interlocking components 158, 160, it is noted the angle plates 150, 152 may be operable to make contact when the fastener 154 is in the first locked configuration, such that the extension 142 is secured at the desired or predetermined angle relative to the hub portion 132 via friction between the angle plates 150, 152, either in addition to or instead of the interlocking components 158, 160.

In embodiments, the first angle plate 150 is positioned on a first surface 162 of the hub portion 132, while the at least one clamp 134 is positioned proximate to a second surface 164 (e.g., which may include the contoured sections 140). For example, the at least one clamp 134 may pass through or otherwise engage the second surface 164, and a corresponding fastener 136 may be positioned proximate to the first surface 162 to receive a portion of the at least one clamp 134 that passed through the second surface 164 toward the first surface 162.

In embodiments, one or more flanges or angle brackets 166 may support the first angle plate 150. The one or more angle brackets 166 may be formed with or affixed one or both of the first angle plate 150 and the hub portion 132 (e.g., are joined by the one or more angle brackets 166).

As generally shown in FIGS. 15-19, the extension 142 is offset at a height above (or below) the frame member 128, but is aligned with the frame member 128 in the same plane and not offset from the frame member 128 either outward or inward. This allows for a better distribution of force and torque exerted by the covering 120 on the frame 108 via the support 106 and the attachment member 130. For example, the lack of inward/outward offset may reduce the moment of the force that the covering 120 exerts on the frame 108 by reducing the inward/outward distance between the extension 142 and the frame member 128. In addition, the positioning of the extension 142 above the frame member 128 instead of to the side of the frame member 128 causes the forces exerted by the covering 120 to be directed into the frame member 128 as opposed to being directed beside the frame member 128, reducing the stress and strain on the attachment member 130.

In this regard, the extension 142 is actuatable between a first position (e.g., use position, constructed position, erected position, or the like) and a second position (e.g., storage or transport position, collapsed position, or the like). For example, the extension 142 is operable to support an upright 106 in the first position wherein the support 106 extends above an object such as the frame 108 and/or the watercraft 104. In addition, the extension 142 is adjustable between the first position in which the system 102 is used and the second position in which the system 102 is stowed. It is noted that the extension 142 may be actuated with the corresponding support 106 being attached (including either with or without the covering 120 being attached to the support 106), or alternatively may be actuated without the corresponding support 106 being attached.

Figure 20:
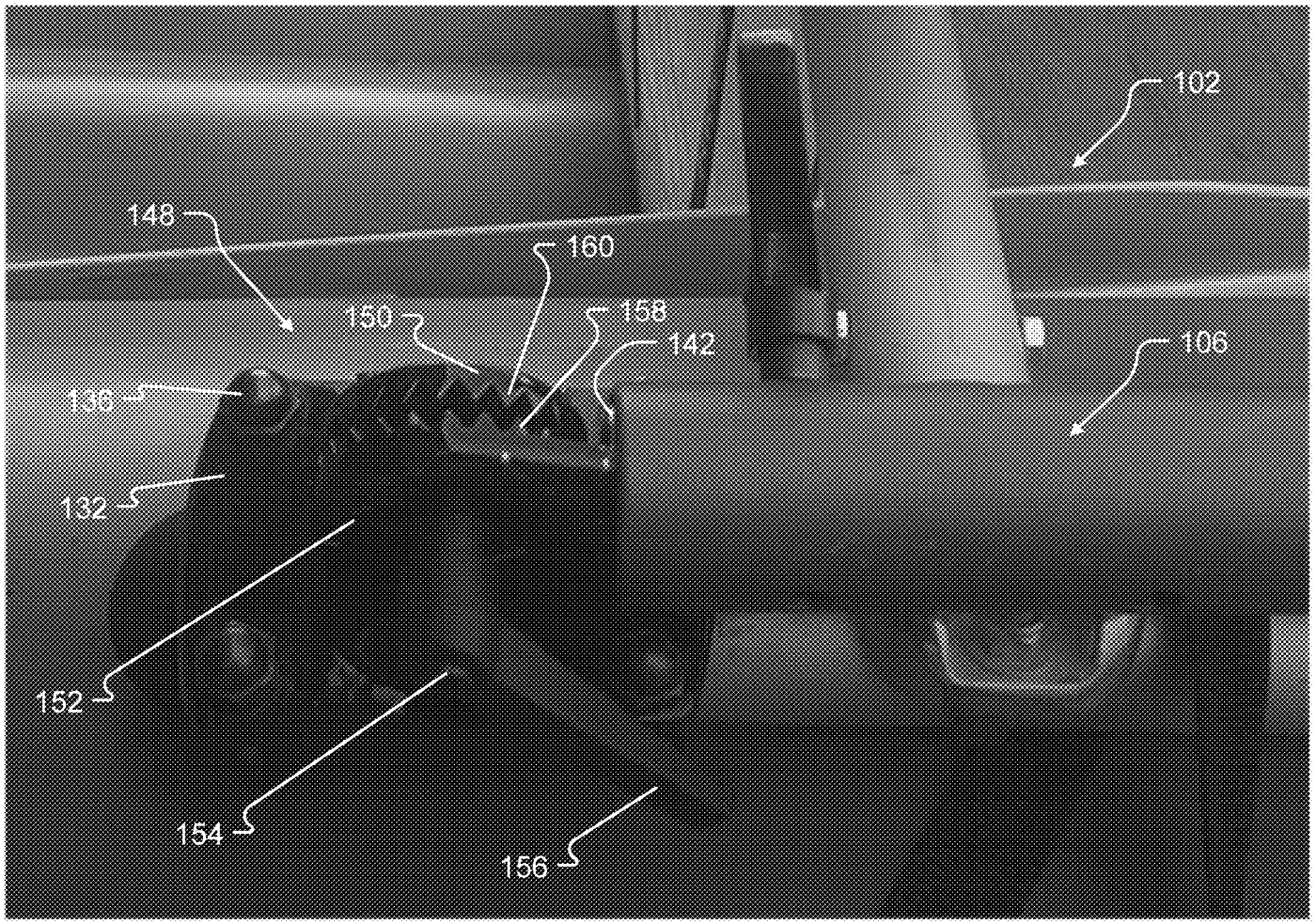
FIG. 20 is a perspective view of a portion of a covering system according to one embodiment of the present disclosure shown in combination with a raft.

FIG. 20 illustrates the system 102 in the second position or collapsed position. In the second position, the interlocking assembly 148 is disengaged, such that the second angle plate 152 and the extension 142 are able to rotate freely (e.g., with the attached support 106) relative to the first angle plate 150 of the hub portion 132. It is noted that FIG. 20 illustrates a displacement or gap between the interlocking components 158, 160 of the angle plates 150, 152, respectively, which allows for the free rotation, as the handle 156 and the fastener 154 are in the second unlocked configuration. As shown in FIG. 20, a fastener and handle similar to those used to couple the extension 142 to the hub portion 132 may be usable to couple the extension 142 and the support 106 together, as an alternative to the pin 114 as disclosed herein.

Figure 21:
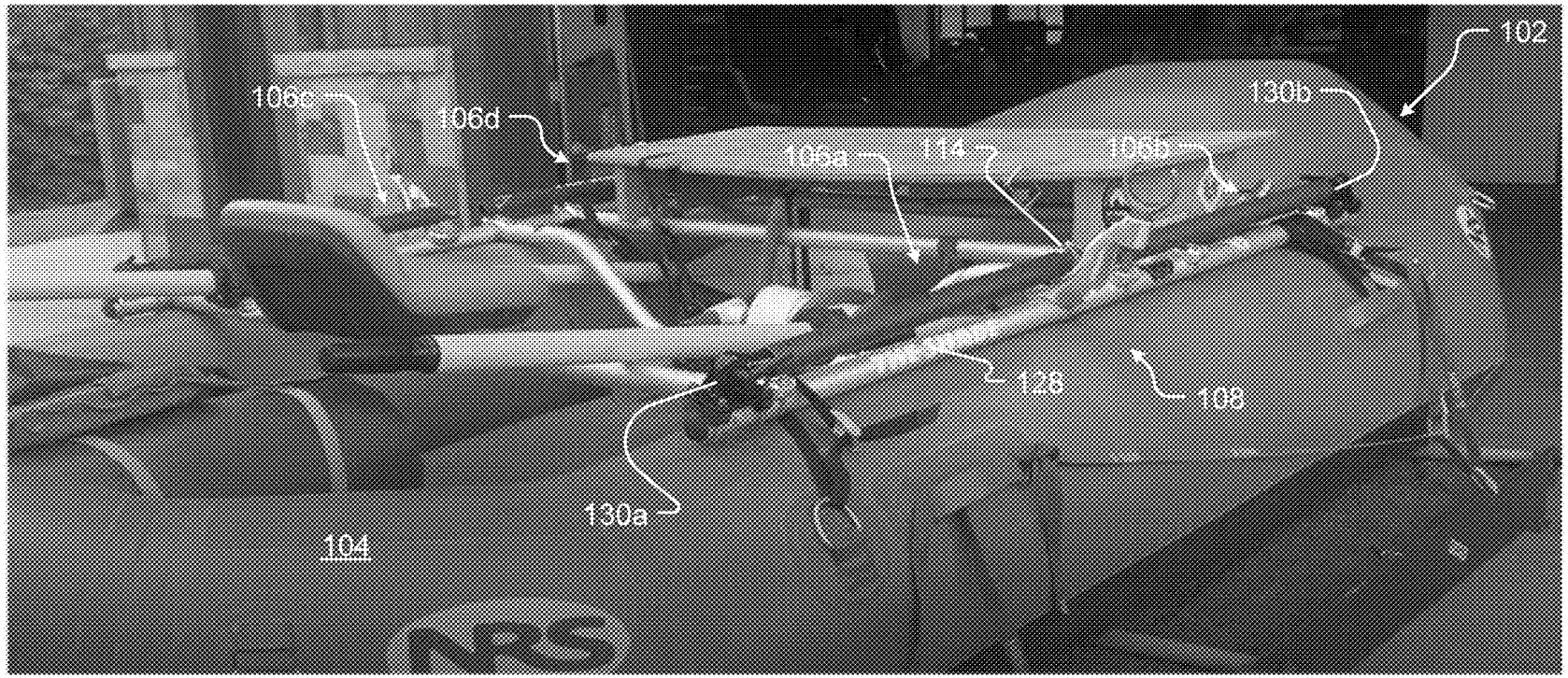
FIG. 21 is a perspective view of a portion of a covering system according to one embodiment of the present disclosure shown in combination with a raft.

FIG. 21 is a perspective view of a shade and covering system 102 in a collapsed arrangement, according to one embodiment of the present disclosure. As shown, the system 102 is provided in combination with the watercraft 104 which is depicted as a raft in FIG. 21. It is noted herein that the embodiments illustrated in FIGS. 13-14 may represent the constructed or erected position that the system 102 may be in either prior to or after the collapsed position as shown in FIGS. 21-22, such that the system 102 may transition between the constructed or erected position in FIGS. 13-14 and the collapsed position in FIGS. 21-22.

As shown in FIG. 13, the system 102 comprises a plurality of supports 106*a*, 106*b*, 106*c*, 106*d*. The supports 106 are contemplated as being selectively connected to the pre-existing frame 108 of the watercraft 104 (for example) or other pre-existing component. The connection between the supports 106 and the frame 108 of the watercraft 104 is not detailed in FIG. 21 and is described elsewhere in this disclosure. The supports 106 of FIG. 21 are contemplated as comprising telescoping members wherein the first portion 110 and the second portion 112 of each of the supports 106 are selectively translatable relative to one another and can be secured in a plurality of different relative positions. The first portion 110 and second portion 112 are selectively securable via the pins 114 (e.g., either alone or with cotter pins, tethers, or the like) operable to extend through at least a portion of the first members and the second members.

Figure 22:
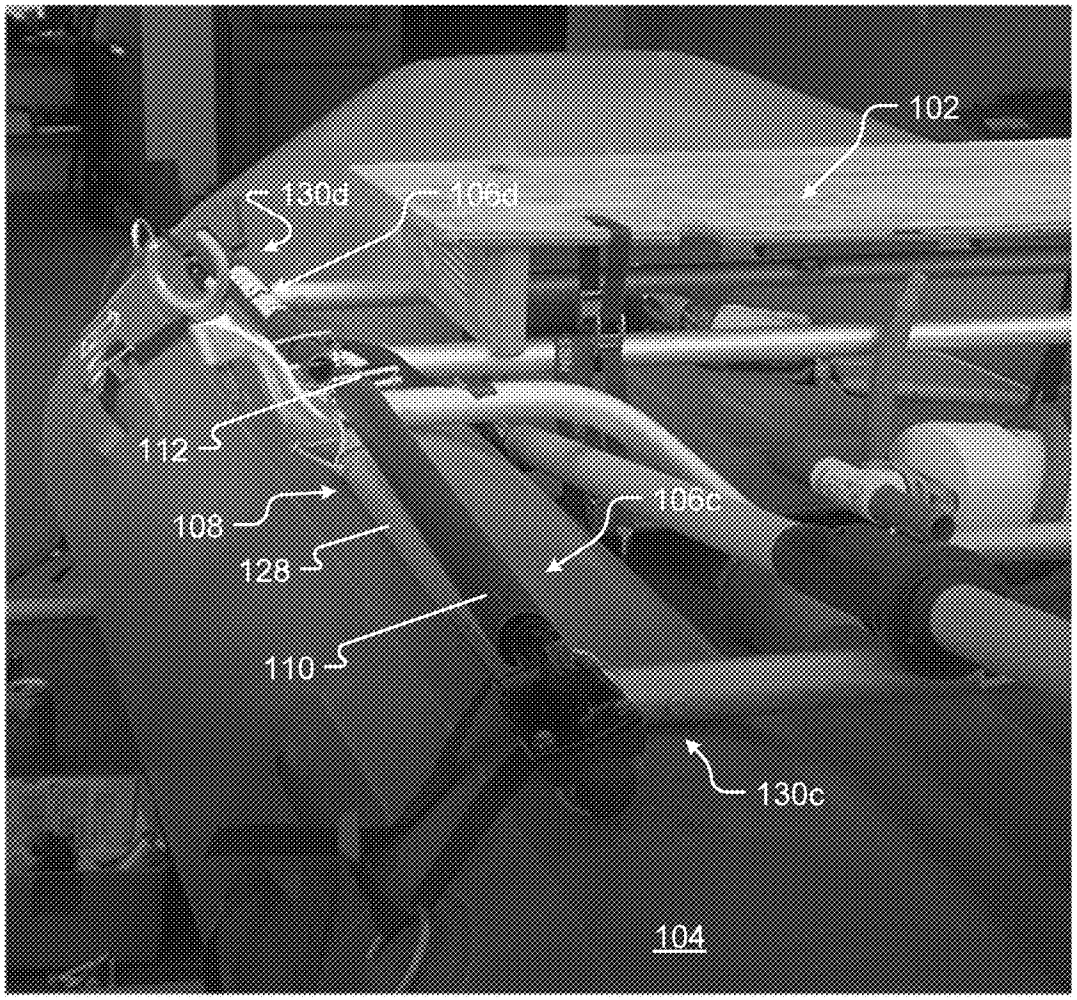
FIG. 22 is a perspective view of a portion of a covering system according to one embodiment of the present disclosure.

FIG. 22 is a perspective view of a portion of the system 102 and watercraft 104 according to the embodiment of FIG. 21. The uprights 106*c*, 106*d* are coupled to frame members 128 of the frame 108 via attachment members 130*c*, 130*d*. In one non-limiting example, the second portion 112 of each of the uprights 106*c*, 106*d* are coupled to a frame member 128 of the frame 108 via respective attachment members 130*c*, 130*d*, and the first portion 110 of each of the uprights 106*c*, 106*d* are coupled to the second portion 112 via the pin 114. For example, the first portion 110 may be slide into the second portion 112 (or over the second portion 112, depending on the relationship between the respective diameters of the first portion 110 and the second portion 112) and the pin 114 couples both portions 110, 112 together.

Figure 19:
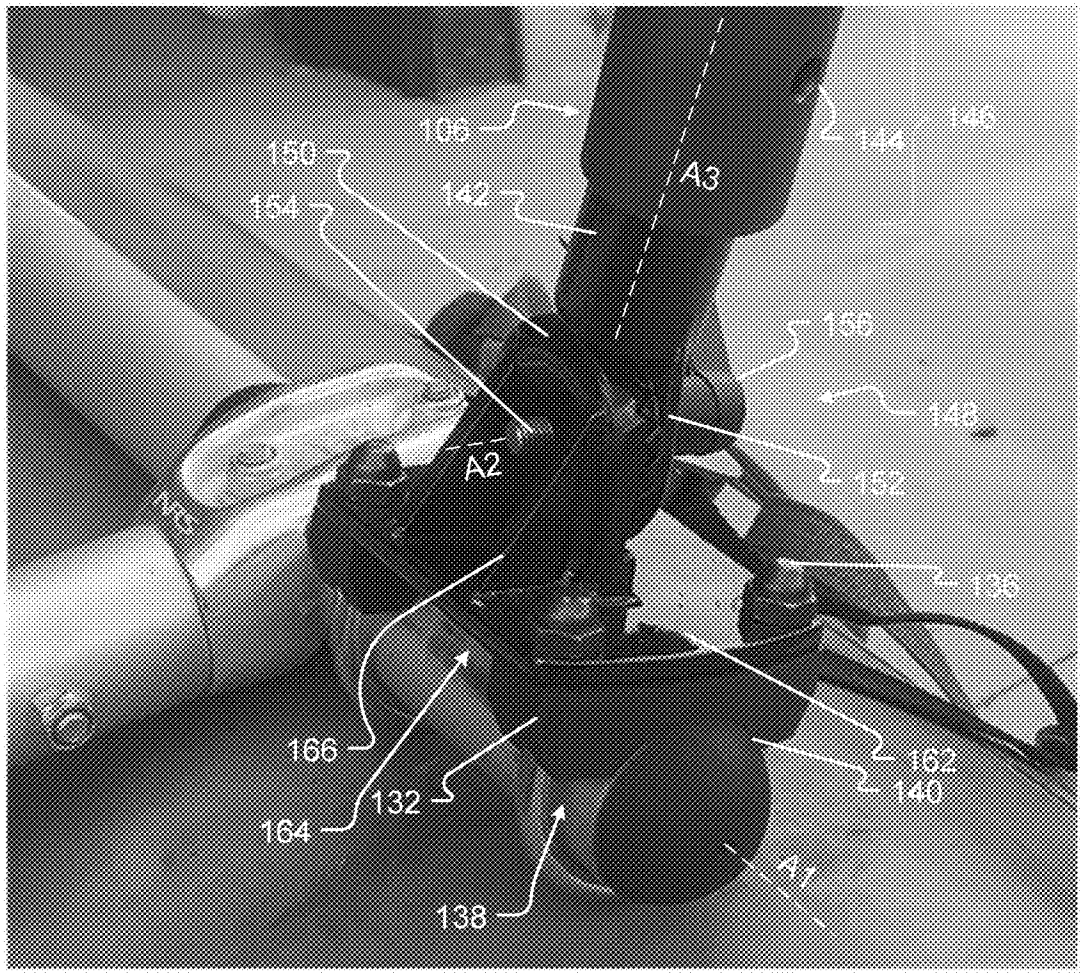
FIG. 19 is a perspective view of a portion of a covering system according to one embodiment of the present disclosure.

As generally understood from FIGS. 13-22 and as shown in FIG. 19, the combination of the hub portion 132 and at least one clamp 134 may be considered as providing a first degree of freedom for the system 102, the interlocking assembly 148 may be considered as providing a second degree of freedom for the system 102, and the coupling between the extension 132 and the support 106 may be considered as providing a third degree of freedom for the system 102.

For example, the hub portion 132 may be positionable at any angle between 0° and 360° relative to the frame member 128 (or at least within a range of angles not inhibited by the watercraft 104), providing a first degree of freedom. The hub portion 132 is rotatable about a first longitudinal axis A1 along the length of (or through) the frame member 128 when the at least one clamp 134 is loosened, but is secured at a desired or predetermined angle relative to the frame member 128 when the at least one clamp 134 is tightened.

In addition, the extension 142 with the second angle plate 152 may be positionable at any angle between 0° and 180° relative to the hub portion 132 with the first angle plate 150, such that the interlocking assembly 148 provides a second degree of freedom. The second angle plate 152 coupled to the extension 142 is rotatable about a second longitudinal axis A2 along the length of (or through) the fastener 154 when the handle 156 is in the second unlocked configuration, but is secured at a second desired or predetermined angle relative to the hub portion 132 when the handle 156 is in the first locked configuration.

Further, the support 106 may be positionable at any angle between 0° and 360° relative to the extension 132 (or at least within a range of angles not inhibited by the covering 120), providing a third degree of freedom, The support 106 is rotatable about a third longitudinal axis A3 along the length (or through) of the extension 132 when the support 106 is not coupled to the extension 132 via the aperture 144, but is secured at a third desired or predetermined angle relative to the extension 132 when a pin or other fastener is inserted into the aperture 144.

It is noted herein the first longitudinal axis through the frame member 128, the second longitudinal axis through the fastener 154, and/or the third longitudinal axis through the extension 132 may be orthogonal, substantially orthogonal, set at an angle relative to one another, or parallel depending on the configuration of the attachment member 130.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A system for providing at least one of covering and shade, the system comprising:

an attachment member, comprising:

a hub portion;

an extension that is rotatable relative to the hub portion between an erected position where the extension has a predetermined angle relative to the hub portion and a collapsed position;

a fastener operable to couple the extension to the hub portion; and a clamp and a corresponding clamp fastener, wherein the attachment member is operable to be selectively secured to a pre-existing component via the clamp and corresponding clamp fastener, wherein the hub portion is rotatable about a first longitudinal axis through the pre-existing component;

a support member, wherein the support member is operable to be secured to the extension, and wherein the support member is operable to rotate relative to the hub portion when secured to the extension; and a covering selectively secured to the support member and operable to provide at least one of shade and cover.

2. The system of claim 1, wherein the pre-existing component comprises an internal frame member of a raft.

3. The system of claim 1, wherein the support member comprises at least two telescoping members that are translatable relative to one another between a raised position and a lowered position, and that are selectively securable by a pin.

4. The system of claim 1, wherein the hub portion includes a section that is contoured to conform to the pre-existing component.

5. The system of claim 1, wherein the extension is rotatable relative to the hub portion about a second longitudinal axis through the fastener operable to couple the extension to the hub portion.

6. The system of claim 5, wherein the support member is rotatable relative to the extension about a third longitudinal axis through the extension.

7. An attachment member for a system for providing at least one of covering and shade, the attachment member comprising:

a hub portion;

an extension that is rotatable relative to the hub portion between an erected position where the extension has a predetermined angle relative to the hub portion and a collapsed position, wherein the extension is able to receive a support member selectively securable to a covering operable to provide at least one of shade and cover;

a fastener operable to couple the extension to the hub portion; and a clamp and a corresponding clamp fastener, wherein the attachment member is operable to be selectively secured to a pre-existing component via the clamp and corresponding clamp fastener, wherein the hub portion is rotatable about a first longitudinal axis through the pre-existing component.

* * * * *